US010932974B2

(12) United States Patent
Eskridge, III et al.

(10) Patent No.: US 10,932,974 B2
(45) Date of Patent: Mar. 2, 2021

(54) ADJUSTABLE BED SYSTEMS WITH ROTATING ARTICULATING BED FRAME

(71) Applicants: Horace Robert Eskridge, III, Lexington, KY (US); Philip Reid Sherman, Melville, NY (US); Philip Woods McCarty, Natick, MA (US); Chuan-Hang Shih, Changhua County (TW)

(72) Inventors: Horace Robert Eskridge, III, Lexington, KY (US); Philip Reid Sherman, Melville, NY (US); Philip Woods McCarty, Natick, MA (US); Chuan-Hang Shih, Changhua County (TW)

(73) Assignee: PPJ, LLC, Natick, MA (US)

( * ) Notice: Subject to any disclaimer, the term of this patent is extended or adjusted under 35 U.S.C. 154(b) by 247 days.

(21) Appl. No.: 15/909,407

(22) Filed: Mar. 1, 2018

(65) Prior Publication Data

US 2018/0369049 A1 Dec. 27, 2018

Related U.S. Application Data

(63) Continuation-in-part of application No. 15/659,412, filed on Jul. 25, 2017.

(Continued)

(51) Int. Cl.
*A61G 7/16* (2006.01)
*A61G 7/015* (2006.01)

(Continued)

(52) U.S. Cl.
CPC ..... *A61G 7/16* (2013.01); *A61G 5/14* (2013.01); *A61G 7/015* (2013.01); *A61G 7/018* (2013.01);

(Continued)

(58) Field of Classification Search
CPC ..... A61G 9/00
See application file for complete search history.

(56) References Cited

U.S. PATENT DOCUMENTS 3,713,619 A 1/1973 Marty
3,786,523 A 1/1974 Sele (Continued)

FOREIGN PATENT DOCUMENTS

DE 202013001182 U1 2/2013
EP 1917949 A1 5/2008

(Continued)

OTHER PUBLICATIONS

VBX Ball Bearings, Sep. 2, 2016 Pertinent Pages: ALL (Year: 2016).*

(Continued)

*Primary Examiner* — David R Hare
*Assistant Examiner* — Adam C Ortiz
(74) *Attorney, Agent, or Firm* — Patent Portfolio Builders PLLC

(57) ABSTRACT

A rotating and articulating bed includes a fixed bed frame with a horizontal support surface, an articulating bed member and a rotating and pivoting frame mounted on the horizontal support surface and in communication with the articulating bed member. The rotating and pivoting frame includes a bearing plate and a plurality of discrete bearings disposed between the bearing plate and the horizontal support surface. The rotating and pivoting frame is rotatable with respect to the horizontal support surface on the plurality of discrete bearings around a vertical axis passing through the horizontal support surface.

20 Claims, 23 Drawing Sheets

Related U.S. Application Data

(60) Provisional application No. 62/366,920, filed on Jul. 26, 2016.

(51) Int. Cl.

| | |
|---|---|
| ***A61G 5/14*** | (2006.01) |
| ***A61G 7/10*** | (2006.01) |
| ***A61G 7/018*** | (2006.01) |
| ***A61G 7/05*** | (2006.01) |

(52) U.S. Cl.

CPC ..... *A61G 7/1025* (2013.01); *A61G 7/0514* (2016.11); *A61G 7/1076* (2013.01); *A61G 2203/12* (2013.01)

(56) References Cited

U.S. PATENT DOCUMENTS

| | | | |
|---|---|---|---|
| 3,911,509 | A | 10/1975 | Fleckenstein |
| 3,940,522 | A | 2/1976 | Wessells |
| 4,279,043 | A | 7/1981 | Saunders |
| 4,411,035 | A | 10/1983 | Fenwick |
| 4,635,894 | A | 1/1987 | Sammons |
| 4,934,003 | A | 6/1990 | Hayakawa et al. |
| 5,054,137 | A | 10/1991 | Christensen |
| 5,079,789 | A | 1/1992 | Jandrakovic |
| 5,311,622 | A | 5/1994 | Allen |
| 5,418,988 | A | 5/1995 | Iura |
| 5,497,518 | A | 3/1996 | Iura |
| 5,507,044 | A | 4/1996 | Williamson et al. |
| 5,903,935 | A | 5/1999 | Huelke |
| 6,155,970 | A | 12/2000 | Dykes et al. |
| 6,711,759 | B1 | 3/2004 | Kluckhuhn |
| 6,880,186 | B2 | 4/2005 | Johansson |
| 6,910,236 | B2 | 6/2005 | René |
| 7,086,103 | B2 | 8/2006 | Barthelt |
| 7,197,780 | B2 | 4/2007 | Petric |
| 7,373,677 | B2 | 5/2008 | Barthelt |
| 7,520,005 | B2 | 4/2009 | Barthelt |
| 7,543,341 | B1 | 6/2009 | Carbaugh |
| 7,788,748 | B2 | 9/2010 | Wurdeman |
| 7,904,978 | B2 | 3/2011 | Wurdeman |
| 7,979,931 | B2 | 7/2011 | Wurdeman |
| 8,127,380 | B2 | 3/2012 | Wurdeman |
| 8,375,489 | B2 | 2/2013 | Manouchehri |
| 8,438,680 | B2 | 5/2013 | Wurdeman |
| 8,495,774 | B2 | 7/2013 | Soltani |
| 8,640,285 | B2 | 2/2014 | Heimbrock et al. |
| 8,677,535 | B2 | 3/2014 | Turner |
| 8,793,825 | B2 | 8/2014 | Tekulve |
| 8,863,332 | B2 | 10/2014 | Rohr |
| 8,887,329 | B2 | 11/2014 | Soltani |
| 9,216,123 | B2 | 12/2015 | Tekulve |
| 9,265,677 | B2 | 2/2016 | Manouchehri et al. |
| 9,539,157 | B2 | 1/2017 | Liu |
| 9,549,864 | B1 | 1/2017 | Tekulve |
| 10,188,567 | B2 | 1/2019 | Wurdeman |
| 2005/0102754 | A1 | 5/2005 | Barthelt |
| 2005/0144720 | A1 | 7/2005 | Poulin et al. |
| 2006/0236458 | A1 | 10/2006 | Barthelt |
| 2007/0017029 | A1 | 1/2007 | Wurdeman |
| 2007/0174968 | A1 | 8/2007 | Barthelt |
| 2008/0148485 | A1 | 6/2008 | Barthelt |
| 2009/0045311 | A1 | 2/2009 | Seyedin et al. |
| 2010/0005591 | A1 | 1/2010 | Manouchehri |
| 2010/0064439 | A1 | 3/2010 | Soltani |
| 2010/0146704 | A1 | 6/2010 | Barthelt |
| 2010/0319121 | A1 | 12/2010 | Polomsky et al. |
| 2012/0079655 | A1 | 4/2012 | Tekulve |
| 2012/0083396 | A1* | 4/2012 | Aquino ..... A63B 21/0004 482/131 |
| 2012/0124746 | A1 | 5/2012 | Andrienko et al. |
| 2013/0007960 | A1 | 1/2013 | Manouchehri et al. |
| 2013/0042412 | A1 | 2/2013 | Shih |
| 2013/0125310 | A1 | 5/2013 | Manouchehri |
| 2013/0289770 | A1 | 10/2013 | Rawls-Meehan |
| 2015/0216750 | A1 | 8/2015 | Miller |
| 2015/0335508 | A1 | 11/2015 | Liu |
| 2016/0120717 | A1* | 5/2016 | Wurdeman ..... A61G 7/015 5/611 |
| 2017/0128295 | A1 | 5/2017 | Tekulve |
| 2017/0208958 | A1 | 7/2017 | Alletto |
| 2018/0014990 | A1 | 1/2018 | Stanislao et al. |
| 2018/0028385 | A1 | 2/2018 | Sherman et al. |
| 2018/0369049 | A1 | 12/2018 | Eskridge, III et al. |

FOREIGN PATENT DOCUMENTS

| | | | |
|---|---|---|---|
| WO | 2010108588 | A1 | 9/2010 |
| WO | 2011003808 | A1 | 1/2011 |

OTHER PUBLICATIONS

International Search Report and Written Opinion dated Oct. 3, 2017 in related International Application No. PCT/US2017/043754.

International Search Report in International Application No. PCT/US2019/49723 dated Nov. 19, 2019. (All references not cited herewith have been previously made of record.).

Written Opinion in International Application No. PCT/US2019/49723 dated Nov. 19, 2019. (All references not cited herewith have been previously made of record.).

International Search Report in International Application No. PCT/US2019/020055 dated May 3, 2019. (All references not cited herewith have been previously made of record.).

Written Opinion in International Application No. PCT/US2019/020055 dated May 3, 2019.

Partial Supplementary European Search Report in corresponding/related European Application No. 17 835 127.6 dated May 6, 2020. (All references not cited herewith have been previously made of record.).

"The Perfect Sleep Chair," firstSTREET for Boomers and Beyond, Inc., 2018.

Extended European Search Report in corresponding/related European Application No. 17 835 127.6 dated Aug. 10, 2020 (all references not cited herewith have been previously made of record).

Screen capture from YouTube video clip entitled "Adjustable bed that swivels the person out," uploaded on Aug. 6, 2020 by user Rotating Hospital Bed, Jun. 25, 2015, Retrieved from Internet: https://www.youtube.com/watch?v=YjU5UGgL1Ac, 1:20 clip.

* cited by examiner

ADJUSTABLE BED SYSTEMS WITH ROTATING ARTICULATING BED FRAME

CROSS-REFERENCE TO RELATED APPLICATIONS

The present application is a continuation-in-part of U.S. patent application Ser. No. 15/659,412 filed Jul. 25, 2017, which claims priority from, U.S. patent application Ser. No. 62/366,920 filed Jul. 26, 2016. The entire disclosures of those applications are incorporated herein by reference.

TECHNICAL FIELD

Embodiments of the subject matter disclosed herein relate to adjustable, articulating bedding systems.

BACKGROUND

Adjustable or articulating beds provide selectable adjustment of the lower or foot portion and upper or head portion of a mattress from a traditional flat or horizontal position. Therefore, the head or foot of a user can be elevated as desired, for example, for comfort, to provide relief from snoring or to facilitate reading. The upper and lower portions are adjustable independent of each other. Adjustment is provided by an articulating foundation mounted on a frame and supporting a mattress.

The support members, hydraulic and pneumatic lifts and actuators associated with the adjustable bed are positioned underneath the sleeping surface of the adjustable bed, extending downward toward the floor. The adjustable bed sits on a frame having side rails that hide the support members, lifts and actuators. These side rails typically extend to the floor and define a distance to the floor or height of the sleeping surface that is fixed. This fixed height is at least a minimum height required to accommodate placement of all the support members, hydraulic and pneumatic lifts, actuators and other electronics that provide the desired articulation in the adjustable bed.

While living room furniture and bathroom fixtures such as showers and tubs have been created to accommodate individuals with limited mobility, adjustable beds, while providing improved comfort and customization while in bed, do not provide accommodations for individuals that may have difficulty getting into and out of bed. The mattress does not rotate or tilt to assist with positioning a body in proper alignment within the adjustable bed. In addition, the location of the support members, lifts and actuators under the adjustable bed in combination with the bed frame can result in an adjustable bed that has a sleeping surface located higher above the floor, which can further inhibit the ability of an individual with limited mobility to get into and out of bed. Therefore, an adjustable bed system is desired that overcomes these limitations of conventional adjustable beds.

SUMMARY

Exemplary embodiments are directed to adjustable bed systems and methods for making and using the adjustable bed systems that accommodate individuals with limited mobility by including a rotating and pivoting mechanism that rotates the sleeping and articulating surfaces of the adjustable bed around a vertical axis passing through the adjustable bed foundation. In one embodiment, this rotating and pivoting mechanism can be adjusted to rotate in either a clockwise or counterclockwise motion. Rotation by the rotating and pivoting mechanism is accomplished in combination with the articulation of the head and foot portions of the adjustable bed foundation. Therefore, the adjustable bed foundation can be rotated while positioned in either a flat, horizontal position or in a position with one or more of the head and foot portions in a raised position. In addition to rotation about the vertical axis, the rotating and pivoting mechanism can also tilt the adjustable bed foundation with respect to a horizontal plane and move the adjustable bed foundation laterally.

Exemplary embodiments are directed to a rotating and articulating bed having a fixed bed frame with a horizontal support surface and an articulating bed member. The articulating bed member includes an articulating head portion, an articulating foot portion separate from the articulating foot portion and a rotating and pivoting frame mounted on the horizontal support surface and in communication with the articulating head portion and the articulating foot portion. The rotating and pivoting frame is rotatable with respect to the horizontal support surface around a vertical axis passing through the horizontal support surface. In addition, the rotating and pivoting frame provides pivoting movement of the articulating bed member with respect to the horizontal support surface to tilt the articulating bed member toward at least one of the articulating head portion and the articulating foot portion.

In one embodiment, the articulating head portion and articulating foot portion each articulate with respect to each other downward toward the horizontal support surface and upward away from the horizontal support surface. Articulation occurs independent of rotation of the rotating and pivoting frame and of pivoting movement of the articulating bed member with respect to the horizontal support surface. In one embodiment, the articulating foot portion articulates downward past a plane containing the horizontal support surface.

In one embodiment, the articulating bed member also includes an articulating center portion disposed between the articulating head portion and the articulating foot portion. The articulating head portion, the articulating center portion and the articulating foot portion articulate with respect to each other independent of rotation of the rotating and pivoting frame and of pivoting movement of the articulating bed member with respect to the horizontal support surface. In one embodiment, the rotating and pivoting frame is pivotally connected to the articulating center to achieve pivoting movement of the articulating bed member with respect to the horizontal support surface.

In one embodiment, the rotating and pivoting frame provides pivoting movement of the articulating bed member with respect to the horizontal support surface to tilt the articulating bed member toward the articulating foot portion from a first position with the articulating foot portion located above the horizontal support surface to a second position with the articulating foot portion extending below the horizontal support surface. In one embodiment, the horizontal support surface is located at a given height, and the articulating foot portion extends below the horizontal support surface a distance greater than or equal to the given height when the articulating bed member is in the second position.

In one embodiment, the rotating and pivoting frame is rotatable around the vertical axis through an angle up to about 90°. In one embodiment, the rotating and pivoting frame is rotatable around the vertical axis in a first direction of rotation through an angle up to about 90° and in a second direction of rotation through an angle up to about 90°. The first direction of rotation is opposite the second direction of rotation. In one embodiment, the rotating and pivoting frame is rotatable around the vertical axis through an angle up to about 360°.

In one embodiment, the articulating bed member includes an articulating center portion disposed between the articulating head portion and the articulating foot portion and a pair of opposing sides extending from the articulating head portion, through the articulating center portion to the articulating foot portion. The articulating center portion has a top surface and a bottom surface opposite the top surface. The rotating and articulating bed further includes a pair of arm assemblies. Each arm assembly is attached to one of the opposing sides and includes an attachment frame connected to the bottom surface of the articulating center portion and an arm connected to the attachment frame at a pivot point and rotatable with respect to the attachment frame around the pivot point. In one embodiment, each arm assembly includes a locking mechanism disposed between the arm and the attachment frame to prevent rotation of the arm with respect to the attachment frame. In one embodiment, the attachment frame is removably connected to the bottom surface of the articulating center portion or the arm is removably connected to the attachment frame.

In one embodiment, the articulating bed member includes an articulating head portion frame, an articulating foot portion frame, an articulating center portion disposed between the articulating head portion the articulating foot portion and containing an articulating center portion frame and at least one mattress removably attached to the articulating head portion frame, articulating center portion frame and articulating foot portion frame. In one embodiment, the articulating bed member includes a plurality of mattresses. Each mattress is removably attached to one of the articulating head portion frame, articulating center portion frame and articulating foot portion frame. In one embodiment, the mattress includes at least one first part of a two-part mechanical fastener and at least one of the articulating head portion frame, articulating center portion frame and articulating foot portion frame includes at least one second part of the two-part mechanical fastener. In one embodiment, the two-part mechanical fastener is a zipper, a hook and loop type fastener, a snap, a pin type fastener, a hook and eye type fastener, a button, a magnetic fastener, a buckle and strap, a clamp, a clasp or combinations thereof.

In one embodiment, the articulating bed member includes a mattress disposed on at least one of the articulating head portion and the articulating foot portion and a mattress topper removably attached to the mattress. In one embodiment, the rotating and pivoting frame further provides lateral movement of the articulating bed member along a plane parallel to and spaced from the horizontal support surface to move the articulating bed member toward the articulating head portion or the articulating foot portion.

Exemplary embodiments are also directed to a rotating and articulating bed having a fixed bed frame with a horizontal support surface and an articulating bed member. The articulating bed member includes an articulating head portion with an articulating head portion frame, an articulating foot portion separate from the articulating foot portion and containing an articulating foot portion frame and an articulating center portion disposed between the articulating head portion and the articulating foot portion and containing an articulating center portion frame. The articulating head portion and articulating foot portion each articulate or pivot with respect to the articulating center portion downward toward the horizontal support surface and upward away from the horizontal support surface. A rotating and pivoting frame is mounted on the horizontal support surface and pivotally connected to the articulating center. The rotating and pivoting frame is rotatable with respect to the horizontal support surface around a vertical axis passing through the horizontal support surface. In addition, the rotating and pivoting frame provides pivoting movement of the articulating center portion with respect to the horizontal support surface to tilt the articulating bed member toward at least one of the articulating head portion and the articulating foot portion. At least one mattress is removably attached to the articulating head portion frame, articulating center portion frame and articulating foot portion frame.

Exemplary embodiments are also directed to a rotating and articulating bed having a fixed bed frame with a horizontal support surface. In one embodiment, the horizontal support surface includes a support plate. The rotating and articulating bed also includes an articulating bed member. In one embodiment, the articulating bed member includes an articulating head portion, an articulating foot portion separate from the articulating head portion and an articulating center portion disposed between the articulating head portion and the articulating foot portion. The articulating head portion, the articulating center portion and the articulating foot portion articulate with respect to each other independent of rotation of the rotating and pivoting frame and of pivoting movement of the articulating bed member with respect to the horizontal support surface. In addition, the rotating and pivoting frame is pivotally connected to the articulating center to achieve pivoting movement of the articulating bed member with respect to the horizontal support surface.

The rotating and articulating bed includes a rotating and pivoting frame mounted on the horizontal support surface. The rotating and pivoting frame is in communication with the articulating bed member. The rotating and pivoting frame includes a bearing plate and a plurality of discrete bearings disposed between the bearing plate and the horizontal support surface. The rotating and pivoting frame is rotatable with respect to the horizontal support surface on the plurality of discrete bearings around a vertical axis passing through the horizontal support surface.

In one embodiment, each discrete bearing includes a housing mounted to the bearing plate, a cover attached to the housing and having a circular opening and a main ball disposed between the housing and the cover. The main ball extends through the circular opening toward the horizontal support surface. In one embodiment, the plurality of discrete bearings is disposed between the bearing plate and the support plate. In one embodiment, each discrete bearing contains a main ball, and each main ball is in contact with the support plate.

In one embodiment, each one of the plurality of discrete bearings is spaced along the bearing plate an equal distance from the vertical axis. In one embodiment, the plurality of discrete bearings includes five discrete bearings. In one embodiment, the five discrete bearings are spaced equally around a circle centered on the vertical axis.

In one embodiment, the rotating and pivoting frame includes a rotating drive shaft extending through the support plate and centered on the vertical axis. The rotating drive shaft has a mounting flange disposed on a first end of the rotating drive shaft, and the mounting flange is in contact with the bearing plate. In one embodiment, the rotating and pivoting frame includes an upper bearing assembly having an upper bearing housing disposed between the mounting flange and the support plate and a thrust ball bearing disposed within the housing. The rotating drive shaft passes through the thrust ball bearing. In one embodiment, the thrust ball bearing includes an upper bearing ring in contact with the mounting flange, a lower bearing ring in contact with the housing and a plurality of ball bearings disposed between the upper bearing ring and the lower bearing ring. The rotating drive shaft is in contact with the plurality of ball bearings.

In one embodiment, the rotating and pivoting frame includes a rotating drive shaft extending through the support plate and centered on the vertical axis. The rotating drive shaft includes a mounting flange disposed on a first end of the rotating drive shaft. The mounting flange is in contact with the bearing plate. The rotating drive shaft includes a second end opposite the first end. The support plate is disposed between the first end and the second end. The rotating and pivoting frame includes a lower bearing assembly with a lower bearing housing disposed between the support plate and the second end of the rotating drive shaft and a thrust ball bearing disposed within the lower bearing housing. The rotating drive shaft passes through the thrust ball bearing. In one embodiment, the thrust ball bearing includes an upper bearing ring in contact with the housing, a lower bearing ring and a plurality of ball bearings disposed between the upper bearing ring and the lower bearing ring. The rotating drive shaft is in contact with the plurality of ball bearings.

In one embodiment, the rotating and pivoting frame includes a threaded locking ring threaded onto the rotating drive shaft between the second end of the rotating drive shaft and the lower bearing assembly. The threaded locking ring is in contact with the lower bearing ring.

In one embodiment, the rotating and pivoting frame includes a rotating drive shaft extending through the support plate and centered on the vertical axis. The rotating drive shaft includes a mounting flange disposed on a first end of the rotating drive shaft. The mounting flange is in contact with the bearing plate. The rotating drive shaft includes a second end opposite the first end, and the support plate is disposed between the first end and the second end. A removable drive collar is disposed over the rotating drive shaft adjacent the second end such that rotation of the drive collar rotates the rotating drive shaft. The drive collar has a pair of arm assemblies extending out from the drive collar. In one embodiment, the rotating and pivoting frame includes a rotation actuator in contact with the fixed frame and one of the arm assemblies. In one embodiment, the rotating and pivoting frame includes a threaded locking ring threaded onto the rotating drive shaft at the second end of the rotating drive shaft. The threaded locking ring is in contact with drive collar.

Exemplary embodiments are also directed to a rotating and articulating bed having a fixed bed frame with a horizontal support surface containing a support plate, an articulating bed member and a rotating and pivoting frame mounted on the horizontal support surface, in communication with the articulating bed member and rotatable with respect to the horizontal support surface around a vertical axis passing through the horizontal support surface. The rotating and pivoting frame includes a bearing plate and a plurality of discrete bearings attached to the bearing plate. Each one of the plurality of discrete bearings is spaced along the bearing plate an equal distance from the vertical axis and the support plate and includes a main ball. Each main ball is in contact with the support plate. In one embodiment, the rotating and pivoting frame further also includes a rotating drive shaft extending through the support plate and centered on the vertical axis. The rotating drive shaft includes a mounting flange disposed on a first end of the rotating drive shaft and a second end opposite the first end. The mounting flange is in contact with the bearing plate, and the support plate is disposed between the first end and the second end.

The rotating and pivoting frame includes an upper bearing assembly with an upper bearing housing disposed between the mounting flange and the support plate and a thrust ball bearing disposed within the housing. The rotating drive shaft passes through the thrust ball bearing. The rotating and pivoting frame includes a lower bearing assembly with a lower bearing housing disposed between the support plate and the second end of the rotating drive shaft and a thrust ball bearing disposed within the lower bearing housing. The rotating drive shaft passes through the thrust ball bearing.

In one embodiment, the rotating and pivoting frame also includes a removable drive collar disposed over the rotating drive shaft adjacent the second end such that rotation of the drive collar rotates the rotating drive shaft. The drive collar includes a pair of arm assemblies extending out from the drive collar. The rotating and pivoting frame includes a rotation actuator in contact with the fixed frame and one of the arm assemblies. In one embodiment, the rotating and pivoting frame includes a lower bearing assembly threaded locking ring threaded onto the rotating drive shaft between the second end of the rotating drive shaft and the lower bearing assembly and a drive collar threaded locking ring threaded onto the rotating drive shaft at the second end of the rotating drive shaft. The drive collar threaded locking ring is in contact with drive collar.

BRIEF DESCRIPTION OF THE DRAWINGS

The accompanying drawings, which are incorporated in and constitute a part of the specification, illustrate one or more embodiments and, together with the description, explain these embodiments. In the drawings.

DETAILED DESCRIPTION

Figure 1:
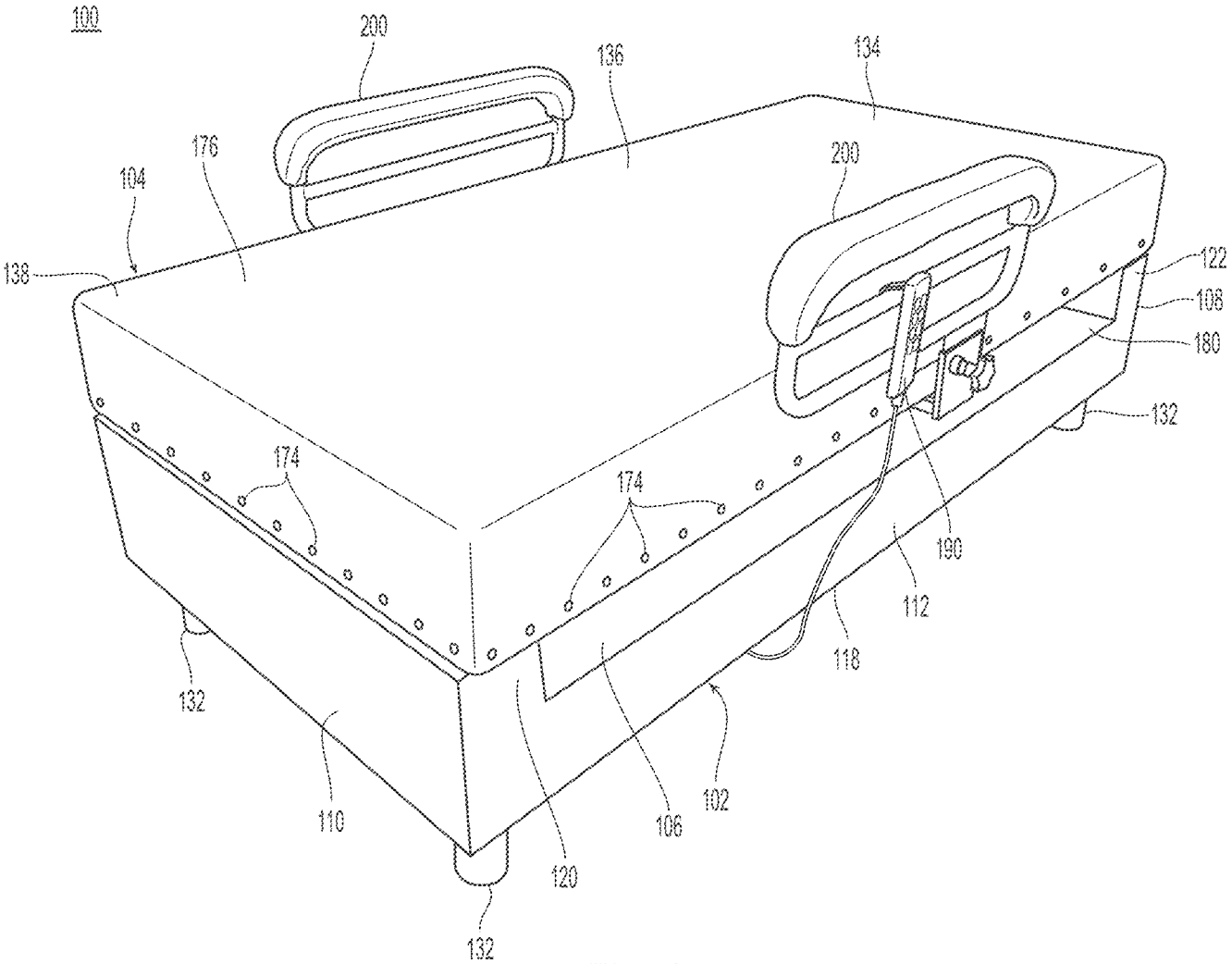
FIG. 1 is a top perspective view of an embodiment of a rotating and articulating bed in a flat position.
Figure 2:
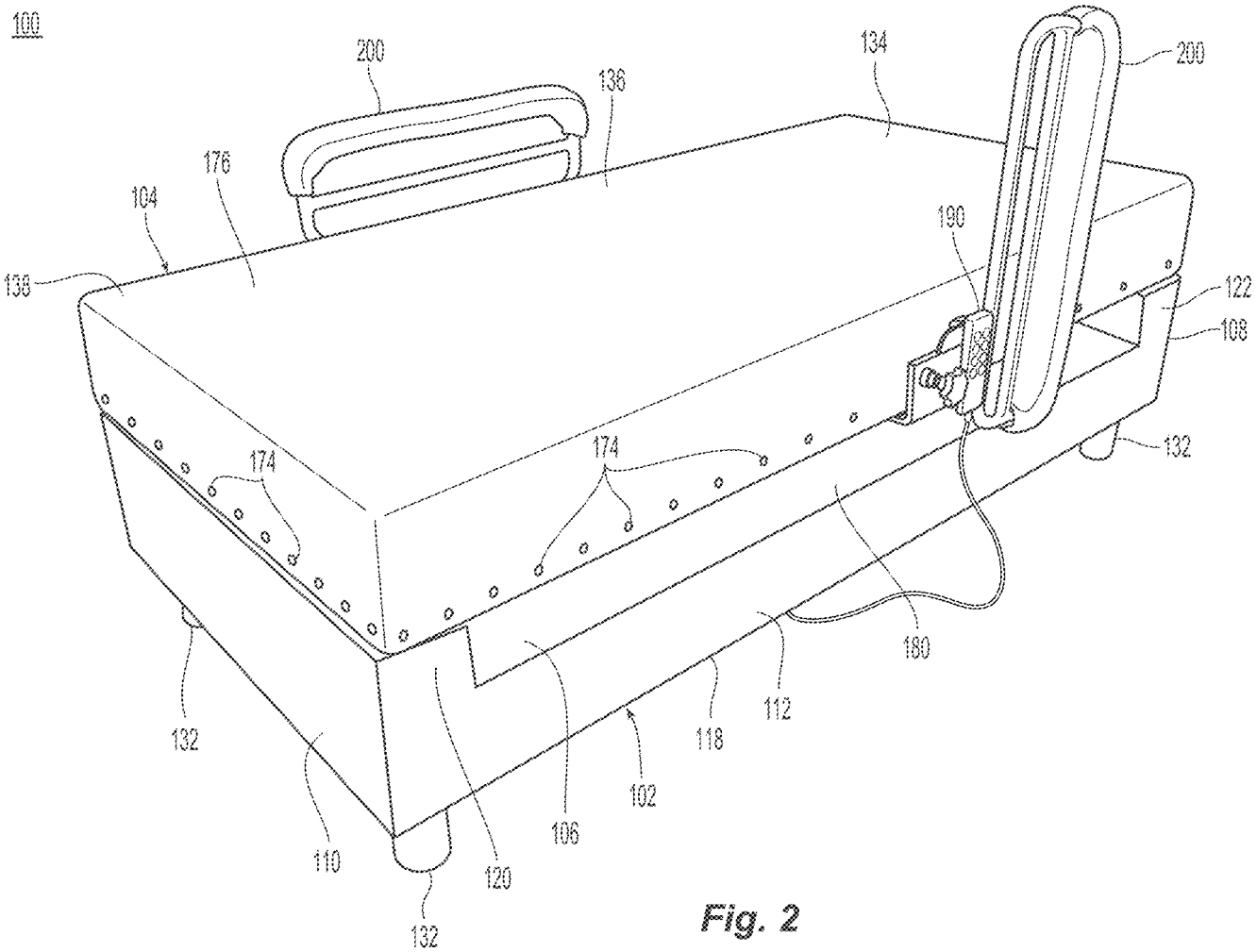
FIG. 2 is a top perspective view of an embodiment of a rotating and articulating bed in a flat position with an arm assembly raised.

The following description of the embodiments refers to the accompanying drawings. The same reference numbers in different drawings identify the same or similar elements. The following detailed description does not limit the invention. Instead, the scope of the invention is defined by the appended claims.

Reference throughout the specification to "one embodiment" or "an embodiment" means that a given feature, structure or characteristic described in connection with an embodiment is included in at least one embodiment of the subject matter disclosed. Thus, the appearance of the phrases "in one embodiment" or "in an embodiment" in various places throughout the specification is not necessarily referring to the same embodiment. Further, the features, structures or characteristics may be combined in any suitable manner in one or more embodiments.

Exemplary embodiments are directed to a rotating and articulating bed. The rotating and articulating bed includes a first, outer, fixed bed frame having a horizontal support surface spaced from the floor and extending between the head end and the foot end of the fixed bed frame. In one embodiment, the rotating and articulating bed includes a head board attached to the head end of the fixed bed frame and a foot board attached to the foot end of the fixed bed frame opposite the head end. In one embodiment, at least one of the head board and foot board extends above the horizontal support surface. The horizontal support surface extends from the head end to the foot end of the fixed bed frame. In addition, the horizontal support surface extends from side to side of the fixed bed frame.

In one embodiment, the fixed bed frame has a base surface opposite the horizontal support surface. The fixed bed frame has a thickness between the based surface and the horizontal support surface. In one embodiment, the base surface is configured to rest directly on the floor. The thickness of the fixed bed frame defines a given height of the horizontal support surface from the floor when the base surface is in contact with the floor. In another embodiment, the fixed bed frame includes a plurality of legs extending down from the base surface. The legs are in contact with the floor and space the base surface from the floor. In another embodiment, the fixed bed frame is attached to and supported by a wheeled, elevating frame having a plurality of wheels. The wheeled elevating frame extends past the base surface and contains the framing members, motors, electronics and controls to selectively position the fixed bed frame in either an elevated position or a lowered position. The base surface of fixed bed frame in the lowered position is located at a height above the floor of about the height of the wheels.

The rotating and articulating bed also includes an articulating bed member disposed on top of or above the horizontal support surface. The articulating bed member includes the framing members, supports, motors, actuators, power sources, control electronics, switches and remotes to provide the desired rotation, articulating, pivoting and sliding of the articulating bed member with respect to the horizontal support surface. The articulating bed member includes an articulating head portion and an articulating foot portion separate from the articulating head portion. The articulating head portion articulates with respect to the articulating foot portion. The articulating bed member includes an articulating center or seat portion disposed between and in contact with the articulating head portion and the articulating foot portion. The articulating head portion and the articulating foot portion articulate with respect to the articulating center portion independent of each other. In addition, the head and foot portions also rest on the base frame member for positional stop in the flat position.

In one embodiment, the articulating bed member includes at least one mattress disposed on and covering the articulating head portion, the articulating center portion and the articulating foot portion. In one embodiment, the articulating head portion includes an articulating head portion frame, and the articulating foot portion includes an articulating foot portion frame. In addition, the articulating center portion includes an articulating center portion frame. The articulating head portion frame, the articulating center portion frame and the articulating foot portion frame articulate with respect to each other. The at least one mattress is attached to at least one of the articulating head portion frame, the articulating center portion frame and the articulating foot portion frame. In one embodiment, the articulating bed member includes three separate mattresses or mattress sections, each separate mattress is attached to one of the articulating head portion frame, the articulating center portion frame and the articulating foot portion frame. In one embodiment, the mattress is releasably attached to at least one of the articulating head portion frame, the articulating center portion frame and the articulating foot portion frame. In one embodiment, the articulating bed member includes at least one mattress topper or mattress pad releasably attached to the mattress.

In one embodiment, the articulating bed member includes a rotating and pivoting frame mounted on the horizontal support surface and in contact with at least one of the articulating head portion, the articulating foot portion and the articulating center portion. In one embodiment, the rotating and pivoting frame is mounted to the horizontal support surface. In one embodiment, framing members, supports, motors, actuators, control electronics, power sources and switches are disposed among the articulating head portion, the articulating foot portion, the articulating center portion and the rotating and pivoting frame to provide the desired articulation for the articulating head portion, the articulating foot portion and the articulating center portion. In one embodiment, the framing members, supports, motors, actuators, control electronics, power sources and switches are disposed between the rotating and pivoting frame and at least one of the articulating head portion, the articulating foot portion and the articulating center portion.

The framing members, supports, motors, actuators, control electronics, power sources and switches also provide for the rotation, pivoting and sliding movement of the articulating bed member with respect to the fixed frame and the horizontal support surface. In one embodiment, the articulating bed member, and in particular the rotating and pivoting frame, rotates with respect to the horizontal support surface in a plane parallel to the horizontal support surface. The articulating bed member rotates around a vertical axis perpendicular to and passing through the horizontal support surface. The articulating bed member rotates around the vertical access through an angle up to 360°.

In addition to rotation in a plane parallel to the horizontal support surface, the articulating bed member pivots with respect to the plane in which it rotates and, therefore, with respect to the horizontal support surface. Pivoting the articulating bed member tilts the articulating bed member forward, i.e., towards the articulating foot portion, or backwards, i.e., toward the articulating head portion. In one embodiment, pivoting motion is provide between the rotating and pivoting frame and the articulating center portion. In one embodiment, in addition to rotational and pivoting movement of the articulating bed member, sliding or lateral movement of the articulating bed member along the plane parallel to the horizontal support surface is provided. In one embodiment, the rotating and pivoting frame provides for lateral or sliding movement along the plane parallel to the horizontal support surface. Lateral or sliding movement occurs in at least one of a direction from side to side of the articulating head portion, the articulating foot portion and the articulating center portion and a direction along a line passing through the articulating bed member from the articulating head portion through the articulating center portion to the foot portion.

In one embodiment, the rotating and articulating bed includes a set or pair of arms. In one embodiment, each arm in the set of arms is located on a side of the articulating bed member and in particular on one side of the articulating head portion, the articulating foot portion or the articulating center portion. Preferably, each arm is located on one side of the articulating center section. In one embodiment, each arm is attached to the side of the articulating center section. Preferably, each arm is attached to the bottom surface of the articulating center section. Attachment to the bottom surface facilitates the use of a removable mattress and the attachment of mattress toppers and sheets to the mattress. In one embodiment, each arm is removable. In one embodiment, each arm is moveable from a first down position with the arm generally parallel to the top surface of the articulating center portion and a second up position with the arm at an angle with respect to the top surface of the articulating center portion. In one embodiment, each arm pivots to move between the first down position and the second up position. In one embodiment, each arm is lockable in at least one of the first down position and the second up position.

The rotating, articulating, pivoting and sliding movement of the articulating bed member, and if included height adjustment of the fixed bed frame, provide access to and use of the rotating and articulating bed by persons with limited mobility. The articulating bed member can be selectively positioned in a variety of arrangements between a horizontal position and a rotated and pivoted position. In the horizontal position, the articulating head portion, the articulating foot portion and the articulating center portion are flat and parallel with the horizontal support surface, and the articulating head portion and the articulating foot portion are aligned with the head end and foot end respectively of the fixed bed frame. In the rotated and pivoted position, the articulating bed member is rotated 90° with respect to the fixed bed frame and articulated and pivoted such that the articulating head portion, the articulating foot portion and the articulating center portion are arranged as a seating position with the articulating foot portion extending over the side of the fixed bed frame and all the way to the surface on which the base surface of the fixed bed frame rests.

In one embodiment, the fixed bed frame includes a head end support and a foot end support to provide support to the articulating head portion and the articulating foot portion in the horizontal position. One or more notches can be provided in the articulating head portion and the articulating foot portion to engage the head end support and the fort end support. From the horizontal position, the articulating head portion, the articulating foot portion and the articulating center portion can be adjusted as in a typical adjustable bed.

In one embodiment, to facilitate a person with limited mobility getting out of the bed, the articulating center portion is rotated with respect to the horizontal support surface with the head portion, foot portion and center portion positioned in accordance with a sitting or reclining position. The articulating bed member continues to rotate while the articulating foot portion is lowered past the plane of the horizontal support surface. At the same time, the articulating bed member is pivoted forward and can also be moved laterally so that the foot portion extends off the side of the horizontal support surface and extends towards the floor. This movement continues, until the articulating bed member has rotated about 90° and the head portion, center portion and foot portion of the articulating bed member are articulated, pivoted and slid to form a chair reaching to the ground and facing the side of the bed. Reversing these steps provides for a person with limited mobility to get into the articulating bed.

Referring now to FIGS. 1-10, an exemplary embodiment of a rotating and articulating bed 100 is illustrated. The rotating and articulating bed includes a fixed bed frame 102 and an articulating bed member 104 mounted on the fixed bed frame. The articulating bed member is mounted on the fixed bed frame to provide rotating, articulating, pivoting and sliding movement of the articulating bed member with respect to the fixed bed frame. Suitable sizes for the rotating and articulating bed including the fixed bed frame and the articulating bed member including twin, full, queen, king and California king.

The fixed bed frame is constructed from framing materials that include wood, metal, composite and plastic framing materials. In addition, the fixed bed frame is covered with upholstery and padding. The fixed bed frame has a head end 108, a foot end 110 opposite the head end and a pair of opposing sides 112 extending from the head end to the foot end. The fixed bed frame has a fixed frame length 114 from the head end to the foot end and a fixed frame width 116 between the pair of opposing sides.

The fixed bed frame includes a horizontal support surface 106 and a base surface 118 opposite the horizontal support surface. In one embodiment, the horizontal support surface extends the entire fixed frame length and the entire fixed frame width. In one embodiment, the fixed bed frame includes a head end support 122 extending up from the horizontal support surface and in from the head end and a foot end support 120 extending up from the horizontal support surface and in from the foot end. In one embodiment, the head end support and the foot end support extend the entire fixed frame width. The horizontal support surface extends from the foot end support to the head end support. The head end support and the foot end support have a support height 124 up from the horizontal support surface. The support height is selected to be sufficient to accommodate framing and operational elements located between the fixed frame and the articulating bed member.

In one embodiment, the horizontal support surface is spaced from the base surface a given distance 126. This given distance is the height of the horizontal support surface from the floor when the base surface is placed in contact with the floor. The given distance and the support height define the overall thickness 128 of the fixed frame. In one embodiment, the fixed from includes a plurality of support legs 132 (FIGS. 1-9) extending down from the base surface. For example, the fixed frame includes four support legs, one support leg adjacent each corner of the fixed frame. In one embodiment, the legs are removable. In one embodiment, the legs are extensible. When the fixed frame includes legs, the height of the horizontal support surface is the overall thickness plus the length of the support legs. In one embodiment, the fixed frame includes a plurality of wheels or rollers at the base surface. Suitable arrangements for wheels and rollers are known and available in the art.

The articulating bed member 104 includes an articulating head portion 134 and a separate articulating foot portion 138. The articulating head portion and articulating foot portion articulate with respect to each other downward toward the horizontal support surface in the direction of arrow B and upward away from the horizontal support surface in the direction of arrow A. Upward and downward articulation provides for movement and positioning of the articulating head portion and articulating foot portion from a flat position illustrated in FIGS. 1, 2 and 10, and various articulated positions illustrated in FIGS. 3-9. In one embodiment, the articulating foot portion articulates downward past a plane 130 (FIG. 10) containing the horizontal support surface (FIG. 7). Articulation of the articulating head portion and the articulating foot portion is conducted independent of other adjustments and movements of the articulating bed member including rotation, pivoting and sliding movement of the articulating bed member with respect to the fixed bed frame and the horizontal support surface.

In one embodiment, the articulating bed member includes an articulating center portion 136 disposed between and in communication with the articulating head portion and the articulating foot portion. The articulating head portion and the articulating foot portion articulate with respect articulating center portion. Articulation of the articulating head portion, the articulating center portion and the articulating foot portion with respect to each other occurs independent of rotational, pivoting and sliding movement of the articulating bed member with respect to the fixed frame. The articulating head portion, articulating center portion and articulating foot portion span the fixed frame length 114 from the head end to the foot end and the fixed frame width 116 between the pair of opposing sides.

In one embodiment, the articulating bed member includes at least one articulating head portion frame 150 disposed in the articulating head portion and at least one articulating foot portion frame disposed in the articulating foot portion. In one embodiment, the articulating bed member includes a first articulating foot portion frame 158 and a second articulating foot portion frame 160 pivotally attached to the first articulating foot portion frame. The first and second articulating foot portion frames provide for separate positioning of the upper leg and lower leg portions of the articulating foot portion. The articulating bed member includes at least one articulating center portion frame 154 disposed between the articulating head portion frame and the articulating foot portion frame, e.g., the first articulating foot portion frame 158.

The articulating center portion frame is pivotally connected to the articulating head portion frame and the articulating foot portion frame. A first actuator assembly 152, i.e., the head portion actuator, is provided between the articulating center portion frame and the articulating heat portion frame. A second actuator assembly 156, i.e., the foot portion actuator, is provided between the articulating center portion frame and the articulating foot portion frame. The actuator assemblies include the actuators, motors, push rods and frame members to provide the desired articulation among the articulating head portion, the articulation center portion and the articulating foot portion.

The articulating head portion, the articulating center portion and the articulating foot portion includes a top surface 140 and a bottom surface 142 opposite the top surface. The articulating head portion, the articulating center portion and the articulating foot portion can be set in a flat, i.e., unarticulated position, with the articulating head portion aligned with the head end of the fixed frame and the articulating foot portion aligned with the foot end of the fixed frame (FIG. 1). The bottom surface at the articulating head portion is aligned over the head end support 122, and the bottom surface at the articulating foot portion is aligned over the foot end support 120. In one embodiment, the bottom surface is in contact with at least one of the head end support and the foot end support. This arrangement defines a space or cavity 180 between the bottom surface and the horizontal support surface that extends from the head end support to the foot end support.

The articulating bed member 104 also includes at least one mattress 176 attached to the articulating head portion frame, articulating center portion frame and articulating foot portion frame. In another embodiment, the articulating bed member includes a plurality of mattresses or mattress sections. Each one of the plurality of mattresses is attached to one of the articulating head portion frame, articulating center portion frame and articulating foot portion frame. In one embodiment, the mattress is not removable from the articulating bed member. In one embodiment, one or more of the articulating head portion frame, articulating center portion frame and articulating foot portion frame is integrated into the mattress. Preferably, the mattress is removably attached to the articulating head portion frame, articulating center portion frame and articulating foot portion frame. Removeable attachment of the mattress is provided by at least one or a plurality of two-part mechanical fasteners 174 disposed between the mattress and each one of the articulating head portion frame, articulating center portion frame and articulating foot portion frame. Suitable two-part mechanical fasteners include, but are not limited to, a zipper, a hook and loop type fastener, a snap, a pin type fastener, a hook and eye type fastener, a button, a magnetic fastener, a buckle and strap, a clamp, a clasp and combinations thereof.

In one embodiment, the mattress, or each one of the plurality of mattresses, includes at least one first part of a two-part mechanical fastener. In addition, at least one of the articulating head portion frame, articulating center portion frame and articulating foot portion frame includes at least one second part of the two-part mechanical fastener. The first and second parts of the two-part mechanical fasteners can be located between the bottom surface of the mattress and the top surface of the articulating head portion frame, articulating center portion frame and articulating foot portion frame. Therefore, the two-part mechanical fastener can be hidden from view. In another embodiment, the two-part mechanical fastener is located between a fabric skirt or side of the mattress and the sides of the articulating head portion frame, articulating center portion frame and articulating foot portion frame.

In one embodiment, a plurality of first parts of a mechanical fasters, i.e., a plurality of first parts of snaps or hook and loop type fasteners, are attached along a bottom skirt area of the mattress or fabric border extending down from the bottom of the mattress, and a corresponding plurality of second parts of the mechanical fasteners are attached to the sides of one or more of the articulating head portion frame, articulating center portion frame and articulating foot portion frame. Therefore, the mattress is placed on top of the articulating head portion frame, articulating center portion frame and articulating foot portion frame with the fabric skirt extending over the sides, and the first and second parts of the two-part mechanical fasteners are aligned. Once aligned, the first and second parts of the two-part mechanical fasteners are connected, securing the mattress to the articulating head portion frame, articulating center portion frame and articulating foot portion frame. Releasing the first and second parts allows removal of the mattress.

In another embodiment, the first part of the two-part mechanical fastener is provided as a first part of a zipper running along the bottom of the mattress. The second part of the two-part mechanical fastener is a second part of the zipper running along one or more of the articulating head portion frame, articulating center portion frame and articulating foot portion frame. In one embodiment, the second part of the zipper is contained in a strip of fabric attached to one or more of the articulating head portion frame, articulating center portion frame and articulating foot portion frame. In another embodiment, the second part of the zipper is provided on a sheet of fabric that is placed under one or more of the articulating head portion frame, articulating center portion frame and articulating foot portion frame. Again, the mattress is placed on the top of the articulating head portion frame, articulating center portion frame and articulating foot portion frame, and the first and second parts of the zipper are aligned. The zipper is then closed, securing the mattress to the articulating head portion frame, articulating center portion frame and articulating foot portion frame.

In one embodiment, articulating bed member includes at least one mattress topper 178 attached to the top of the mattress and disposed on at least one of the articulating head portion, the articulating center portion and the articulating foot portion. In one embodiment, the articulating bed member includes a plurality of mattress toppers. Each mattress topper is attached to one of a plurality of mattresses. Suitable mattress toppers provide protection for the mattress or impart a soft cushion surface to the top of the surface. While the mattress topper can be fixed to the top of the mattress, for example using stitching, preferably the mattress topper is removably attached to the top of the mattress. In one embodiment, the mattress topper includes the first part of a two-part mechanical fastener, and the mattress includes a second part of the two-part mechanical fastener. Suitable two-part mechanical fasteners include, but are not limited to, a zipper, a hook and loop type fastener, a snap, a pin type fastener, a hook and eye type fastener, a button, a magnetic fastener, a buckle and strap, a clamp, a clasp and combinations thereof. In one embodiment, the mattress topper is secured to the mattress using a plurality of elastic straps.

In one embodiment, the articulating bed frame includes a rotating and pivoting frame 144. The rotating and pivoting frame is disposed in the cavity 180 and is mounted on the horizontal support surface 106. In one embodiment, the rotating and pivoting frame is positioned on or above a support plate 146 mounted to the horizontal support surface. In one embodiment, the rotating and pivoting frame is in communication with and attached to at least one of the articulating head portion and the articulating foot portion. In another embodiment, the rotating and pivoting frame is in communication with and connected to the articulating center portion. In one embodiment, connection to the articulating head portion, the articulating center portion or the articulating foot portion is connection to the articulating head portion frame, the articulating center portion frame or the articulating foot portion frame.

The rotating and pivoting frame 144 is rotatable with respect to the horizontal support surface or the support plate around a vertical axis 148 passing through and perpendicular to the horizontal support surface and the support plate. The rotating and pivoting frame also provides pivoting movement of the articulating bed member with respect to the horizontal support surface to tilt the articulating bed member toward at least one of the articulating head portion as indicated by arrow C, and the articulating foot portion as indicated by arrow D. In one embodiment, the rotating and pivoting frame pivots the articulating center portion or the articulating center portion frame backwards towards the articulating head portion or forward towards the articulating foot portion. In one embodiment, the rotating and pivoting frame is pivotally connected to the articulating center portion or the articulating center portion frame. In one embodiment, the rotating and pivoting frame is pivotally connected to the articulating center portion or the articulating center portion frame at one or more pivot points 170.

In one embodiment, the rotating and articulating bed includes a shaft 166 passing from the fixed bed frame through the support plate and into the rotating and pivoting frame. The shaft is a cylindrical shaft that is concentric with vertical axis. In one embodiment, the rotating and pivoting frame is rotatable around the vertical axis through an angle up to about 90° in a single direction of rotation around the vertical axis. In another embodiment, the rotating and pivoting frame is rotatable around the vertical axis in a first direction of rotation through an angle up to about 90° and in a second direction of rotation through an angle up to about 90°. The first direction of rotation is opposite the second direction of rotation. In one embodiment, the rotating and pivoting frame is rotatable around the vertical axis through an angle up to about 360°.

In one embodiment, the rotating and pivoting frame 144 includes a bearing plate 169 disposed on top of the support plate 146. A bearing surface is defined between the bearing plate and the support plate, and the bearing plate rotates with respect to the support plate on the bearing surface. In one embodiment, a plastic bearing member is included between the bearing plate and the support plate. In another embodiment, bearings, including ball bearing and roller bearings are provided between the bearing plate and the support plate, for example, in channels or grooves in the bearing surface, to improve rotation between the bearing plate and the support plate.

Figure 13:
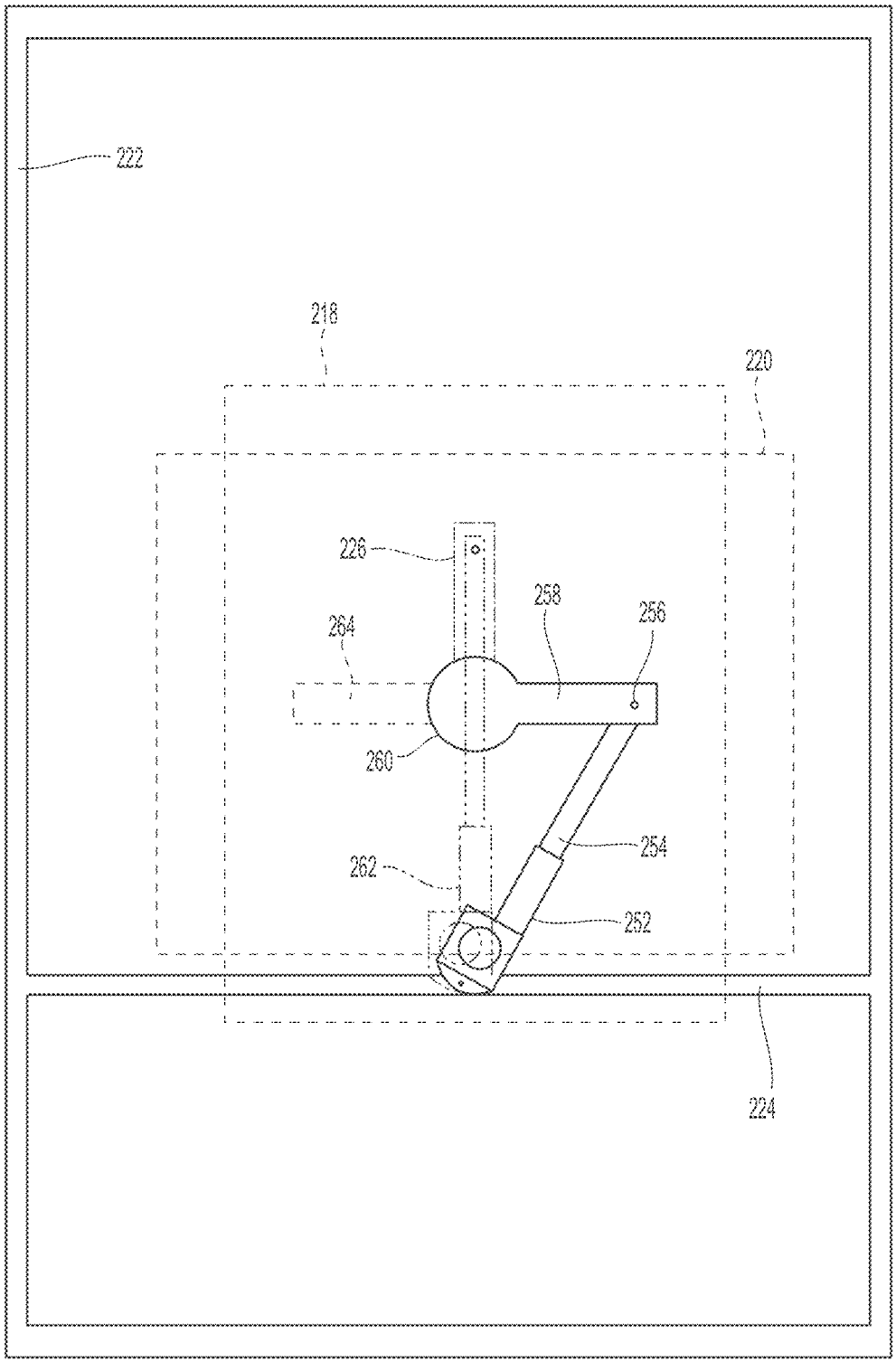
FIG. 13 is a schematic representation of a rotation actuator for rotating the shaft and bearing plate.

In one embodiment, the bearing plate is fixedly attached to the shaft 166 and does not rotate with respect to the shaft. Therefore, rotation of the shaft rotates the bearing plate. Referring now to FIG. 13, in one embodiment, the rotation actuator 252, i.e., the actuator that provides rotation of the bearing plate, is a linear actuator that is disposed within the fixed frame 222 and rotationally or pivotally connected to a frame member 224 within the fixed frame. The extensible rod 254 of the rotation actuator is connected to an arm 258 attached to and extending from the shaft 260 at a pivot point 256. The shaft is fixedly connected to the bearing plate. Therefore, when the rotation actuator is in a first position, e.g., retracted, the bearing plate is in a first non-rotated position 218. Extending the extensible rod moves the rotation actuator to a second position 262 and the arm to a second position 226. This also rotates the shaft and moves the bearing plates to a second rotated position 220, which represents 90° of rotation in a first direction. Rotation of the shaft and therefore the bearing plate through 90° degrees in a second direction opposite the first direction can be accomplished by having the arm in a reversed first position 264.

Returning to FIGS. 1-10, in another embodiment, a motor is provided in communication with one end of the shaft disposed in the rotating and pivoting frame. The motor is fixedly attached to the shaft and to the rotating and pivoting frame, e.g., the bearing plate. Therefore, the motor rotates the bearing plate and therefore the rotating and pivoting frame around the shaft. In another embodiment, a motor 164 is disposed in the fixed frame and is in contact with a portion of the shaft disposed in the fixed frame. The motor is fixedly attached to the fixed frame and to the shaft. In addition, the portion of the shaft extending into the rotating and pivoting frame is fixedly secured to the rotating and pivoting frame, i.e., the bearing plate. Therefore, the motor rotates the shaft around the vertical axis, and the rotating shaft rotates the rotating and pivoting frame around the vertical axis.

In one embodiment, the rotating and pivoting frame includes a pair of parallel frames members 182 spaced from each other and extending under the articulating center portion and articulating center portion frame. Each frame member includes a top 184, and the articulating center portion frame articulates with respect to each top from an initial position that is in contact with or adjacent and parallel to the tops to positions in which the articulating center portion frame is at an angle to each top. In one embodiment, each frame member is connected to the articulating center portion frame, for example at a pivot point. In one embodiment, the articulating center portion frame is attached to each frame member to provide both pivoting and sliding movement of the articulating center portion with respect to the rotating and pivoting frame.

In one embodiment, each parallel frame member is secured to the bearing plate, for example, by welds or using a plurality of fasteners such as bolts. In one embodiment, each frame member is attached to the bearing plate using three fasteners, one adjacent either end of the frame member and one in the middle of the frame member. Therefore, rotation of the bearing plate rotates the parallel frame members. The fasteners do not interfere with the rotation of the bearing plate with respect to the support plate. In one embodiment, a pivot actuator 168 is disposed on the bearing plate between the parallel frame members. Preferably, the pivot actuator is a linear actuator. The pivot actuator is disposed between and pivotally attached to the bearing plate and the articulating center portion frame. Movement of the pivot actuator, and in particular the push rod of the pivot actuator, produces pivoting movement of the articulating center portion. Therefore, the rotating and pivoting frame includes four actuators, a head portion actuator, a foot portion actuator, a rotation actuator and a pivot actuator. In one embodiment, all four actuators are linear actuators. In one embodiment, all four actuators are identical actuators.

Figure 14:
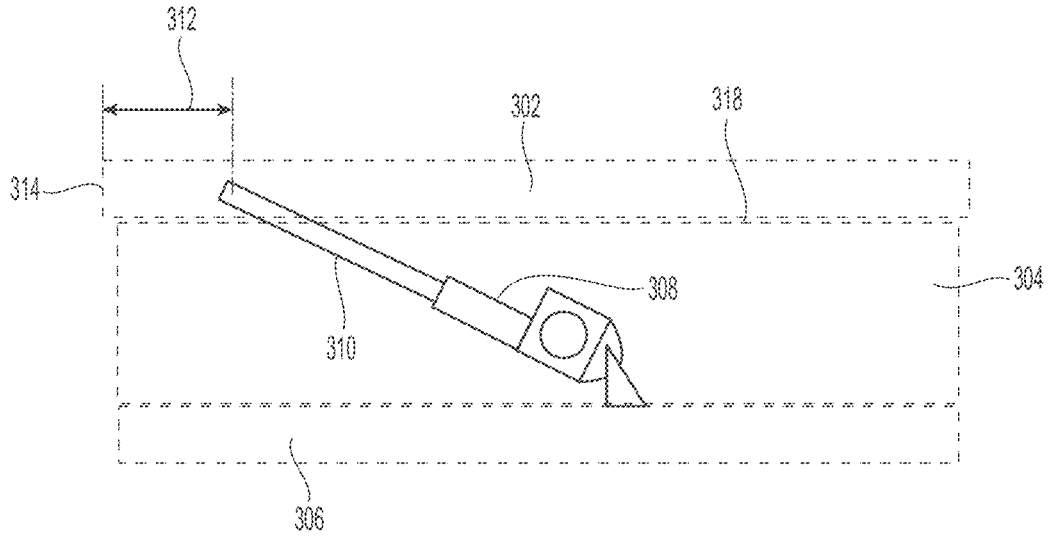
FIG. 14 is a schematic representation of a pivot actuator attached to the articulating center portion frame and with the articulating center portion frame in an initial flat position.
Figure 15:
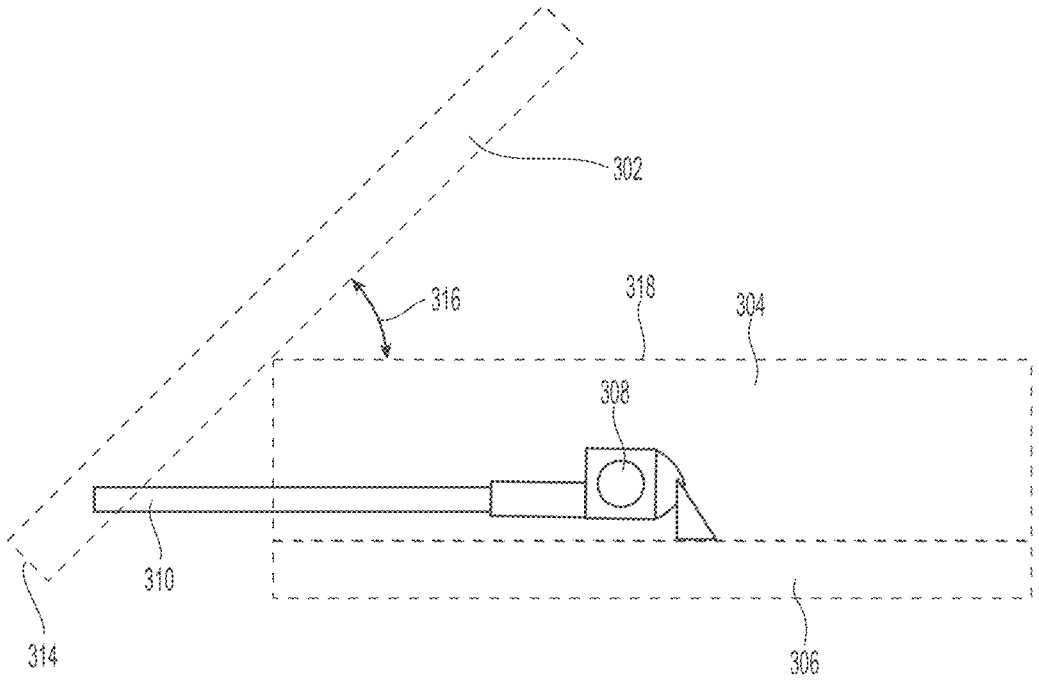
FIG. 15 is a schematic representation of a pivot actuator attached to the articulating center portion frame and with the articulating center portion frame pivoted toward the articulating foot portion.

Referring now to FIGS. 14 and 15, in one embodiment, the pivot actuator 308 is pivotally connected to the top of the bearing plate 306 between the parallel frame members 304. The end of extensible rod 310 of the pivot actuator is rotationally or pivotally connected to the articulating center portion frame 302. In one embodiment, the extensible rod is connected and spaced a distance 312 from the end 314 of the articulating center portion frame adjacent the articulating foot portions. In one embodiment, the distance is about 8 inches. When the pivot actuator is in a first retracted position, the articulating center portion frame 302 is substantially flat and located above and parallel to the top surfaces 318 of the parallel frame members (FIG. 14). Extending the extensible rod pivots the articulating center portion frame, and therefore, the articulating bed member, toward the foot end (FIG. 15). This lifts the articulating center portion frame off the top surfaces of the parallel frame members and defines an angle 316, i.e., the pivot angle, between the articulating center portion frame and the top surfaces. The pivot actuator also pivots downward toward the bearing plate. In addition, the end 314 of the articulating center portion frame drops below the plane of the top surfaces 318 of the parallel frame members and toward the horizontal support surface or floor. Retracting the pivot actuator returns the articulating center portion frame, and therefore, the articulating bed member, to the position illustrated in FIG. 14.

Returning to FIGS. 1-10, in one embodiment, the articulating center portion pivots independent of any sliding movement. For example, the rotating and pivoting frame member includes an actuator that pushes on the articulating center portion frame to pivot the articulating center portion around the pivot points. In addition, articulating bed member can slide with respect to the fixed bed frame either in a direction from side to side of the fixed bed frame as indicated by arrow E or in a direction from the head end to the foot end of the fixed bed frame as indicated by arrow by arrow F. The articulating bed member slides in a plane parallel to the plane of the horizontal support surface. In one embodiment, the rotating and pivoting frame member can slide with respect to the mounting plate and the articulating center portion frame. In another embodiment, the articulating center portion simultaneously slides and pivots with respect to the rotating and pivoting frame.

The rotating and articulating bed includes a control assembly 164. Preferably, the control assembly is located in the fixed bed frame. The control assembly is in communication with the motors and actuators of the rotating and articulating bed to provide for the desired adjustments and operation of the rotating and articulating bed. The control assembly includes, but is not limited to, control electronics, computers, programmable logic controllers, power supplies, batteries and wireless communication systems. In one embodiment, the rotating and articulating bed includes at least one remote control 190 in communication with the control assembly. Suitable remote controls include wireless and wired controllers. The remote control provides for articulating, pivoting and sliding movement of the rotating and articulating bed.

Figure 3:
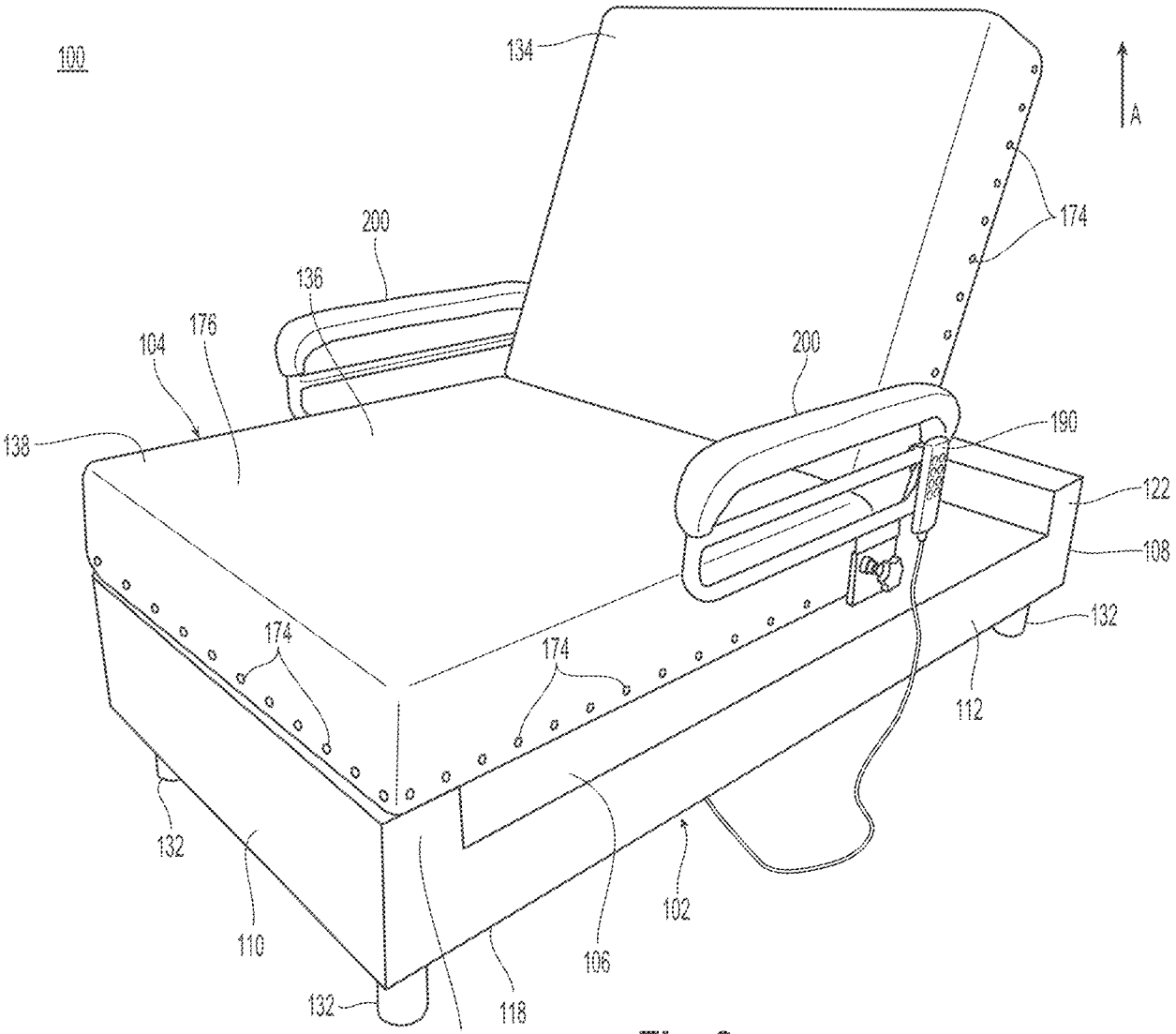
FIG. 3 is a is a top perspective view of an embodiment of a rotating and articulating bed with the articulating head portion raised.
Figure 4:
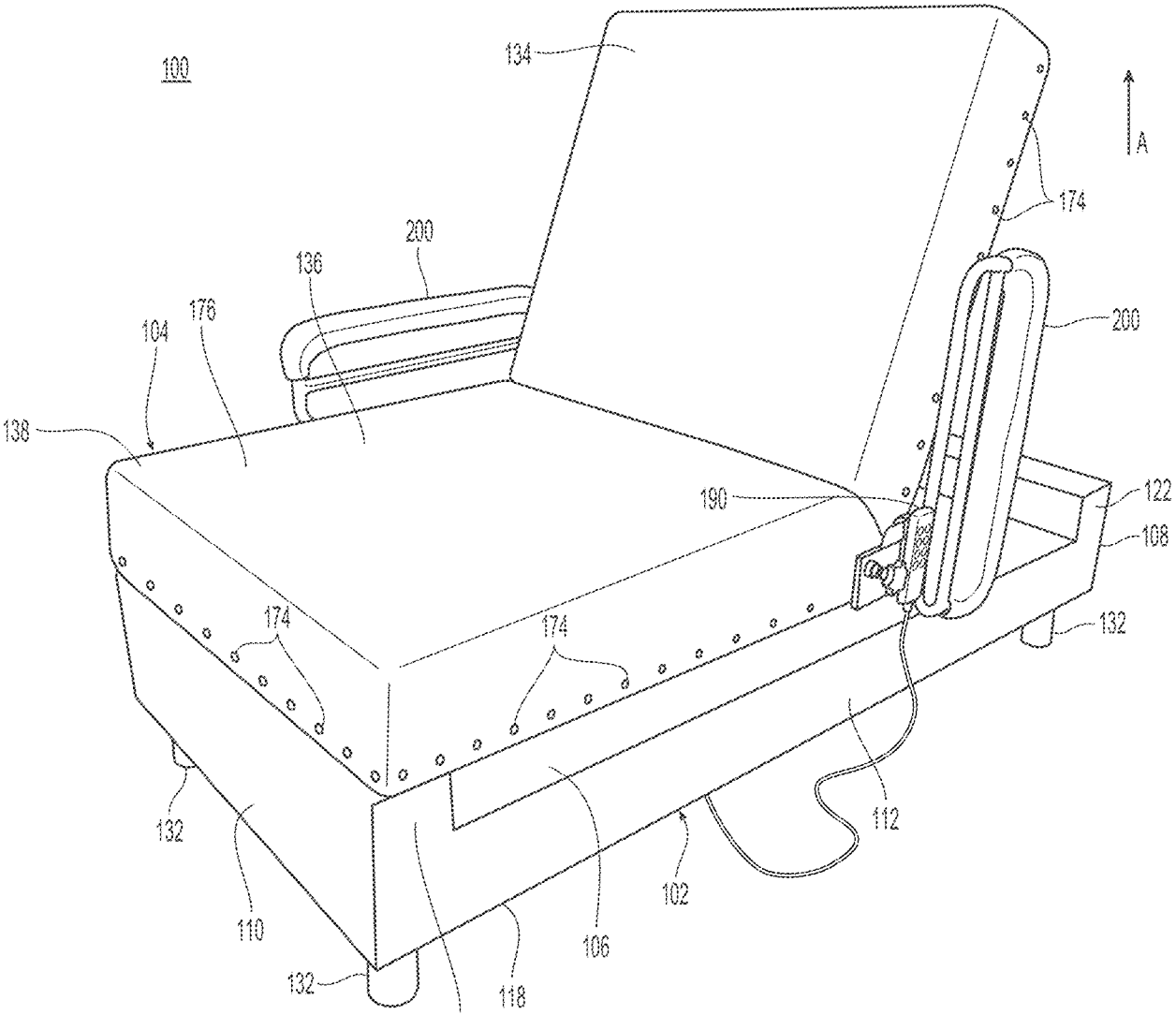
FIG. 4 is a top perspective view of an embodiment of a rotating and articulating bed with the articulating head portion raised and an arm assembly raised.

The rotating and articulating bed further includes a pair of arm assemblies 200. Each arm assembly is attached to one of the opposing sides of the articulating bed member. Preferably, each arm assembly is connected to an opposing side of the articulating center portion and in particular the articulating center portion frame. Each arm assembly can be positioned in a first lowered position with the one or more of the articulating head portion, articulating center portion and articulating foot portion in either a flat arrangement (FIG. 1) or an articulated arrangement (FIG. 3). Each arm assembly can be positioned in a second raised position with the one or more of the articulating head portion, articulating center portion and articulating foot portion in either a flat arrangement (FIG. 2) or an articulated arrangement (FIG. 4).

Figure 11:
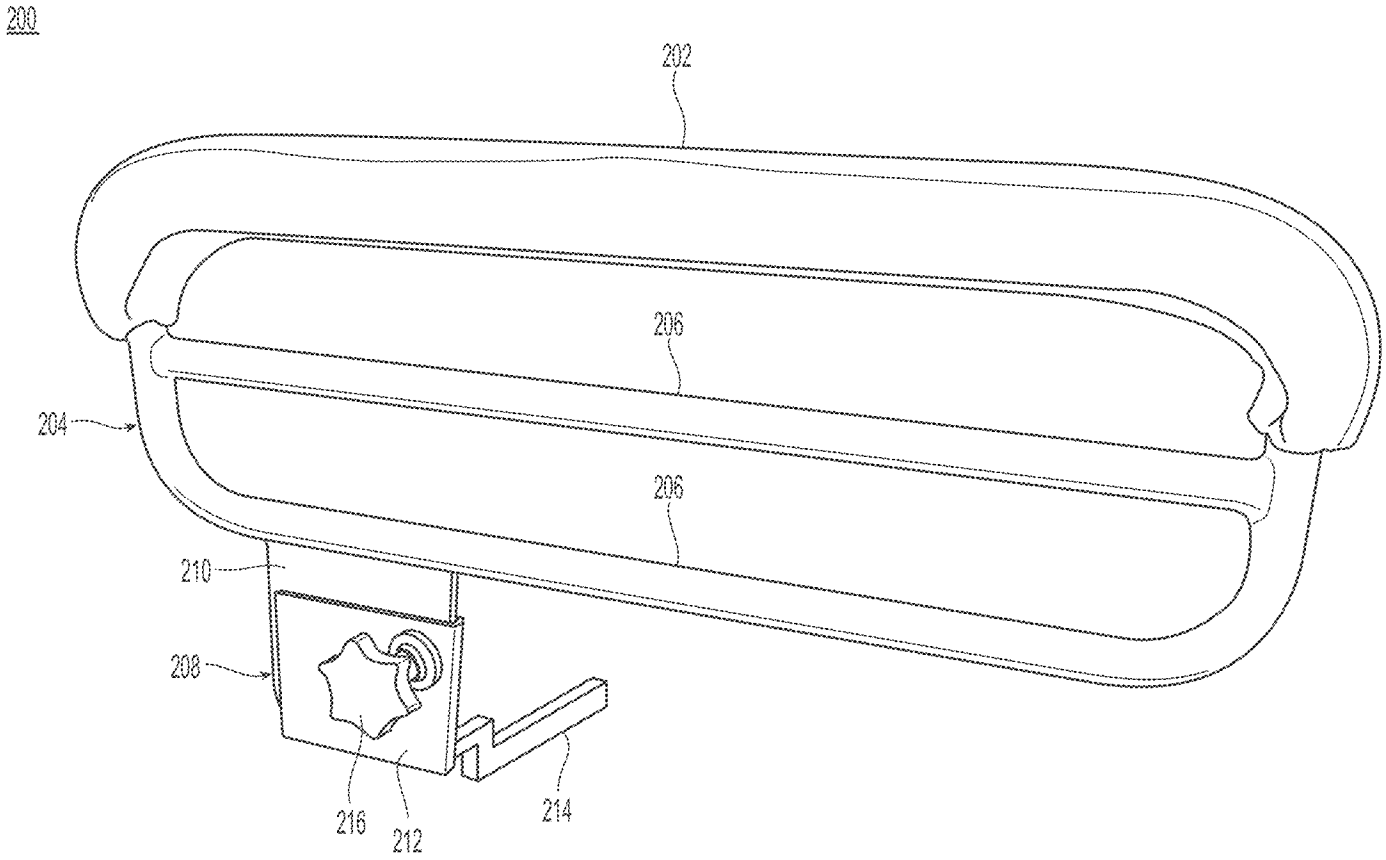
FIG. 11 is a perspective view of an embodiment of an arm assembly.
Figure 12:
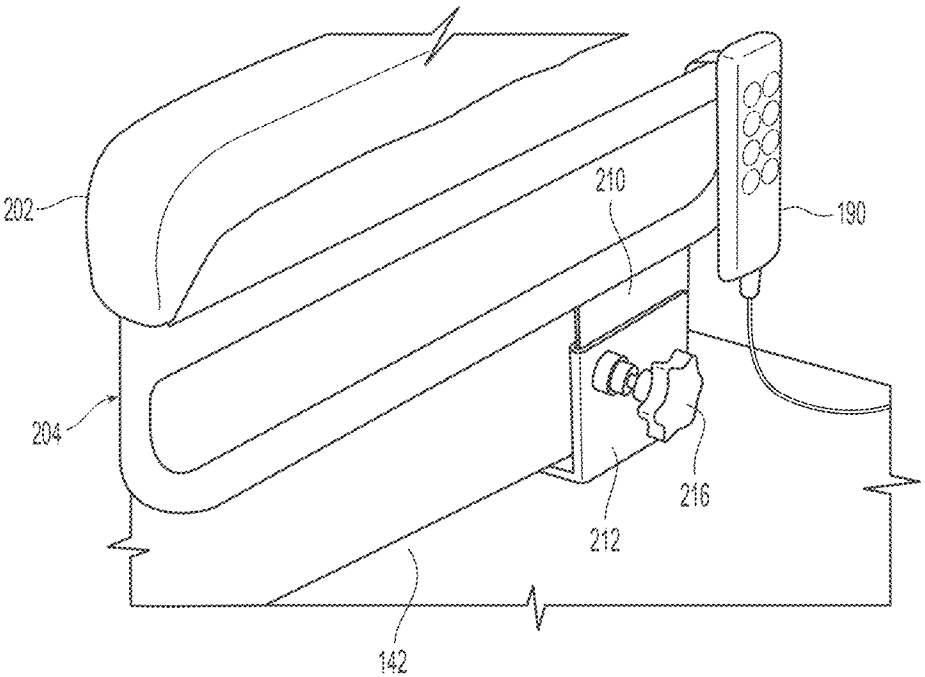
FIG. 12 is a partial view of an embodiment of an arm assembly attached to a bottom surface of an articulating center portion of the rotating and articulating bed.

Referring now to FIGS. 11 and 12, each arm assembly includes an arm assembly frame 204 having a plurality of parallel horizontal frame members 206. Suitable materials for the assembly frame include tubular metals. A padded cover 202 is attached to the top horizontal frame member. An attachment frame 208 is connected to the arm assembly frame. The attachment frame includes a flange 210 attached or welded to the bottom horizontal frame member. A mounting plate 212 is pivotally connected to the flange 210. A mounting arm 214 extends from the mounting plate. The mounting arm includes a bend or extends downward from the mounting plate to connect the arm assembly to the bottom surface 142 (FIG. 10) of the articulating center portion and in particular the articulating center portion frame. In one embodiment, the mounting arm and therefore the attachment frame is removably attached to the articulating center portion. The mounting plate pivotally connected to the flange, providing a pivot point between the arm assembly frame and the attachment frame such that the arm assembly frame is rotatable respect to the attachment frame and in particular the mounting plate around the pivot point. In one embodiment, each arm assembly and in particular each attachment frame includes a locking mechanism 212 disposed between the flange of the arm assembly frame and the mounting plate of the attachment frame to prevent rotation of the arm assembly with respect to the attachment frame. Suitable locking mechanisms include set screws and spring-loaded pins. In one embodiment, the arm assembly is removably connected to the attachment frame.

In one embodiment, the different portions of the rotating and articulating bed can be dissembled for shipping and storage. Therefore, one or more of the fixed bed frame, legs, rotating and pivoting frame, articulating head portion frame, articulating center portion frame, articulating foot portion frame, mattress, mattress topper, arm assembly and control assembly are constructed as separate assemblies. These separate assemblies are then assembled into the rotating and articulating bed.

The rotating and pivoting frame of the rotating and articulating bed provides pivoting movement of the articulating bed member with respect to the horizontal support surface to tilt the articulating bed member toward the articulating foot portion from a first position with the articulating foot portion located above the horizontal support surface to a second position with the articulating foot portion extending below the horizontal support surface. The horizontal support surface is located at a given height above the floor, and the articulating foot portion extends below the horizontal support surface a distance greater than or equal to the given height when the articulating bed member is in the second position. Therefore, the articulating foot portion extends at the way to the floor. In one embodiment, rotating and pivoting frame provides lateral movement of the articulating bed member along a plane parallel to and spaced from the horizontal support surface to move the articulating bed member toward the articulating head portion or the articulating foot portion.

Figure 5:
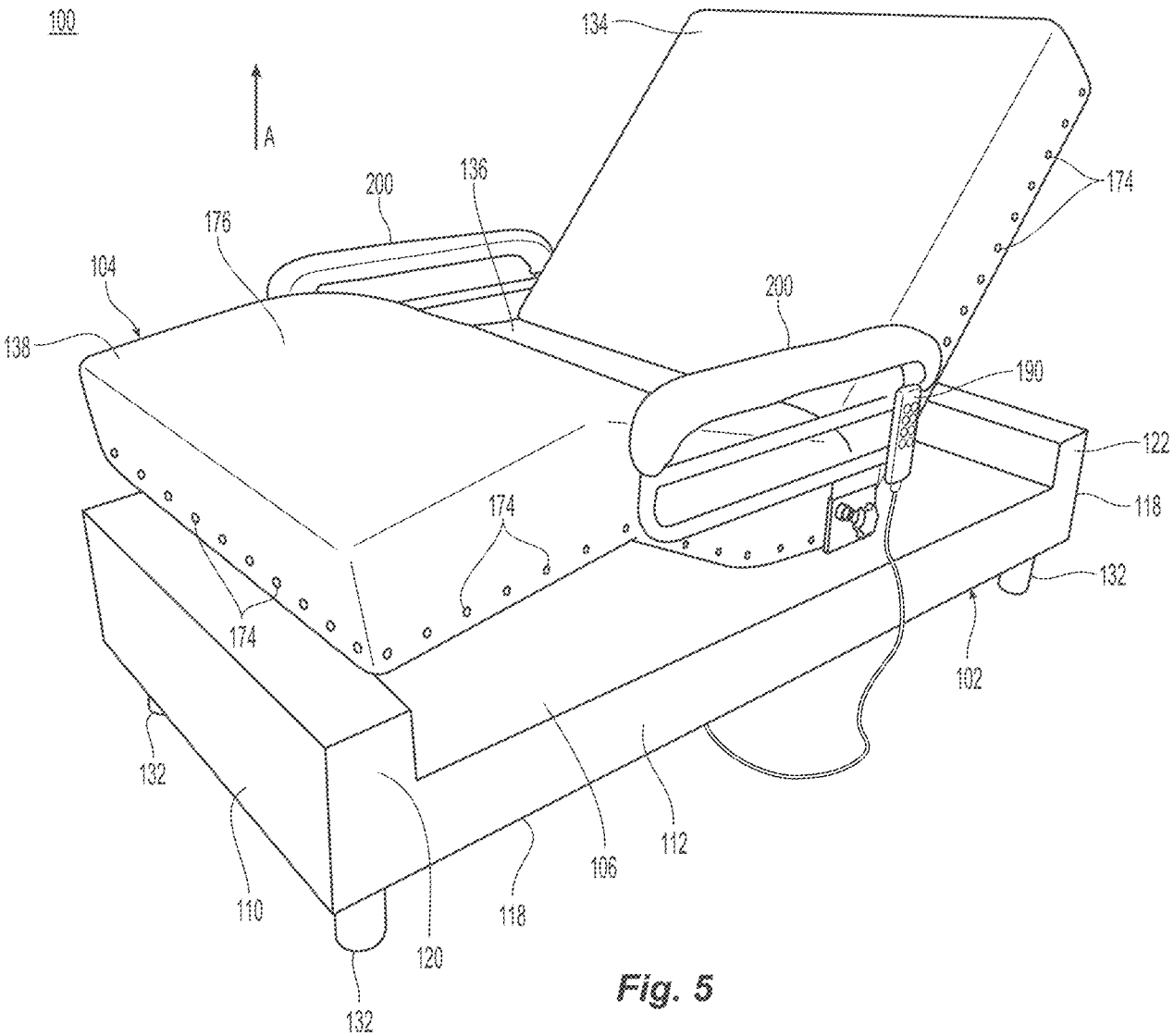
FIG. 5 is a top perspective view of an embodiment of a rotating and articulating bed with the articulating head portion raised and the articulating foot portion raised.

The articulating bed member can be positioned with the articulating head portion, the articulating center portion and the articulating foot portion flat and parallel to the horizontal support surface (FIG. 1). The arm assemblies can be down to provide side support rails or raised (FIG. 2) to facilitate entry into the rotating and articulating bed frame. From this flat position, with the articulating head portion, the articulating center portion and the articulating foot portion aligned with the head end and foot end of the fixed bed frame, the rotating and articulating bed is operated as an articulating bed to raise and lower the articulating head portion (FIG. 3) or the articulating head portion, the articulating center portion and the articulating foot portion (FIG. 5). The arm assemblies can also be raised when one or more of the articulating head portion, the articulating center portion and the articulating foot portion are articulated (FIG. 4) to provide movement into and out of the rotating and articulating bed in the articulated position.

Figure 6:
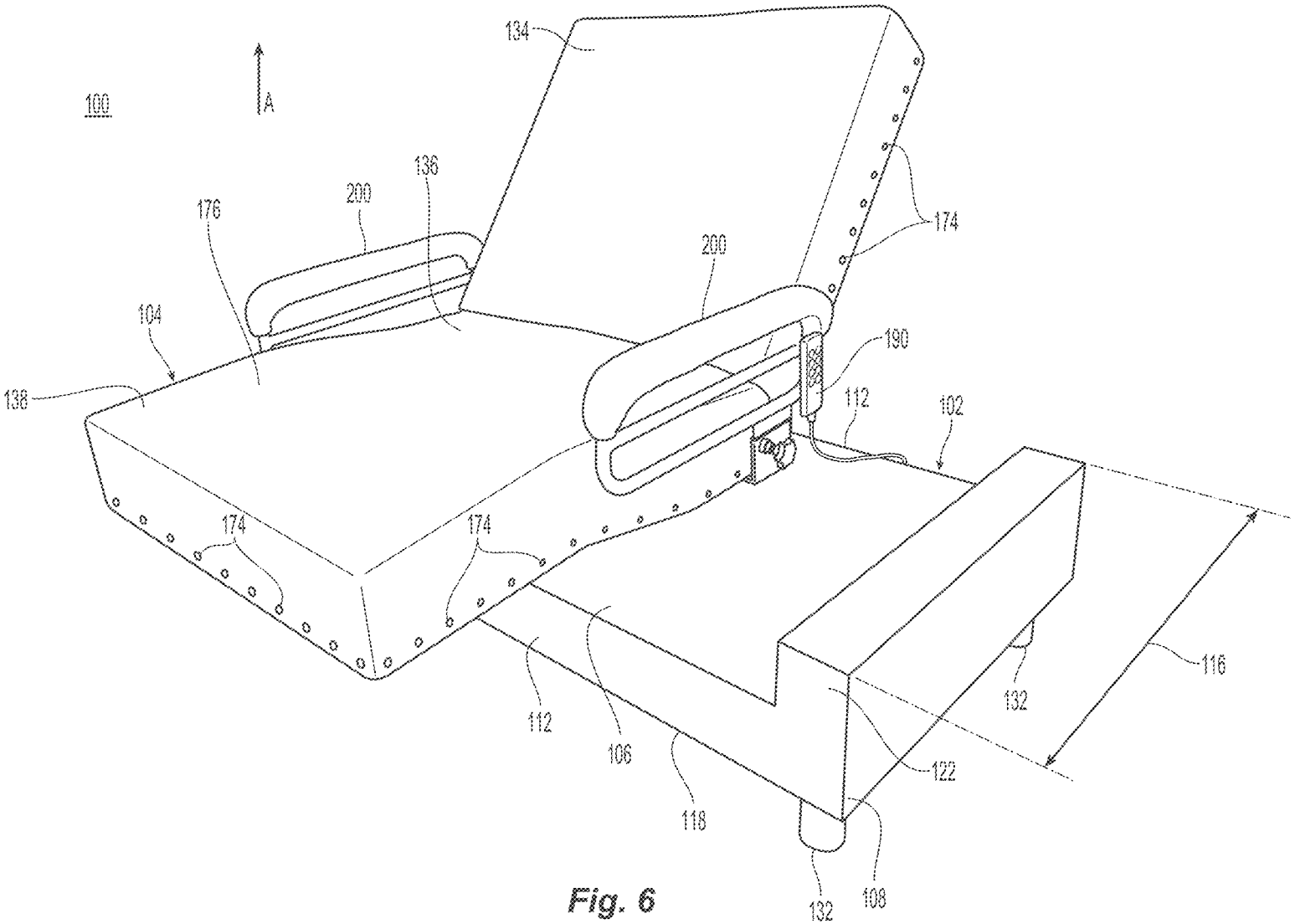
FIG. 6 is a top perspective view of an embodiment of a rotating and articulating bed with the articulating head portion raised, the articulating foot portion raised and the articulating bed member rotated 90°.
Figure 7:
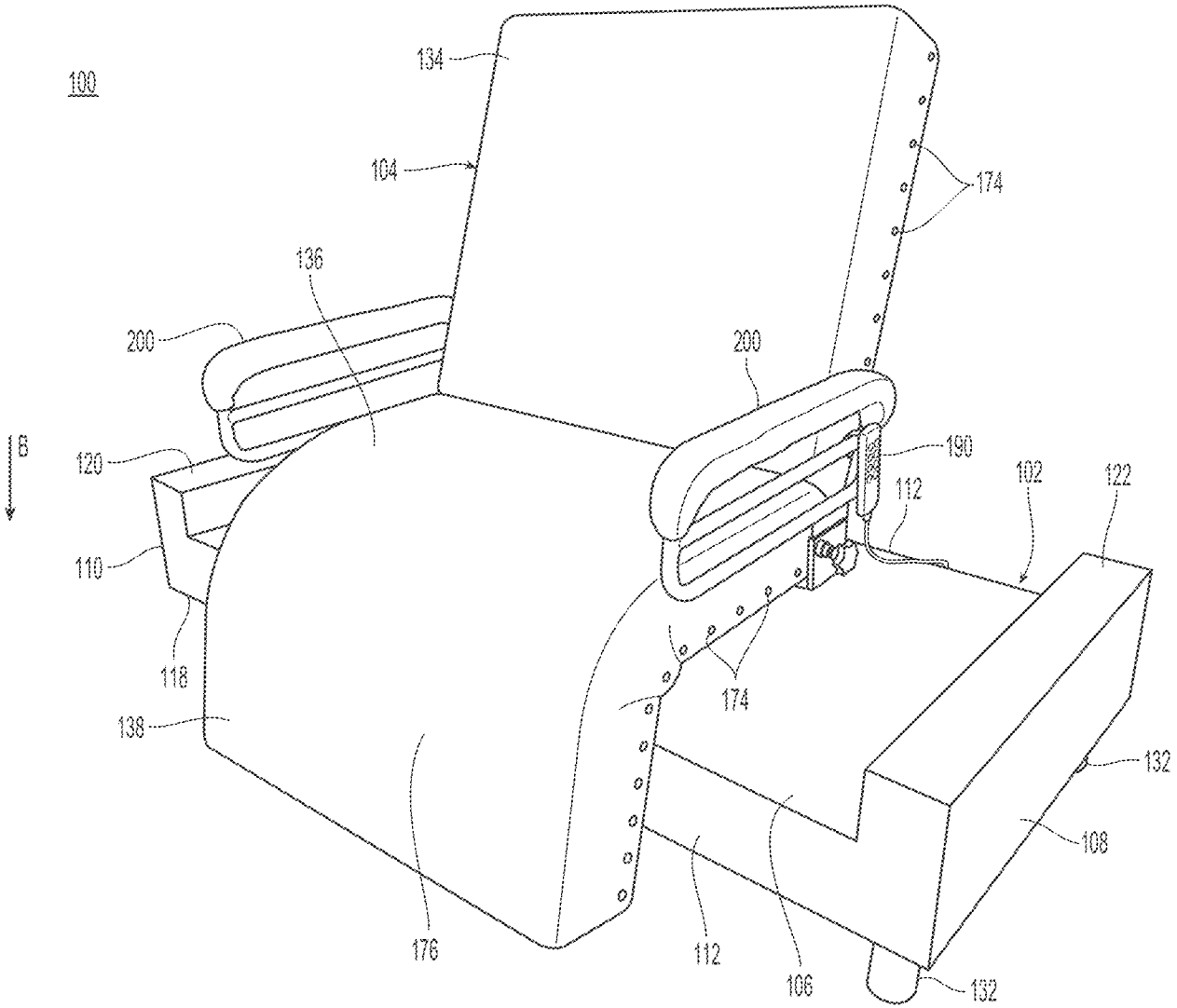
FIG. 7 is a top perspective view of an embodiment of a rotating and articulating bed with the articulating head portion raised, the articulating bed member rotated 90° and the articulating foot portion lowered past the plane of the horizontal support surface.
Figure 8:
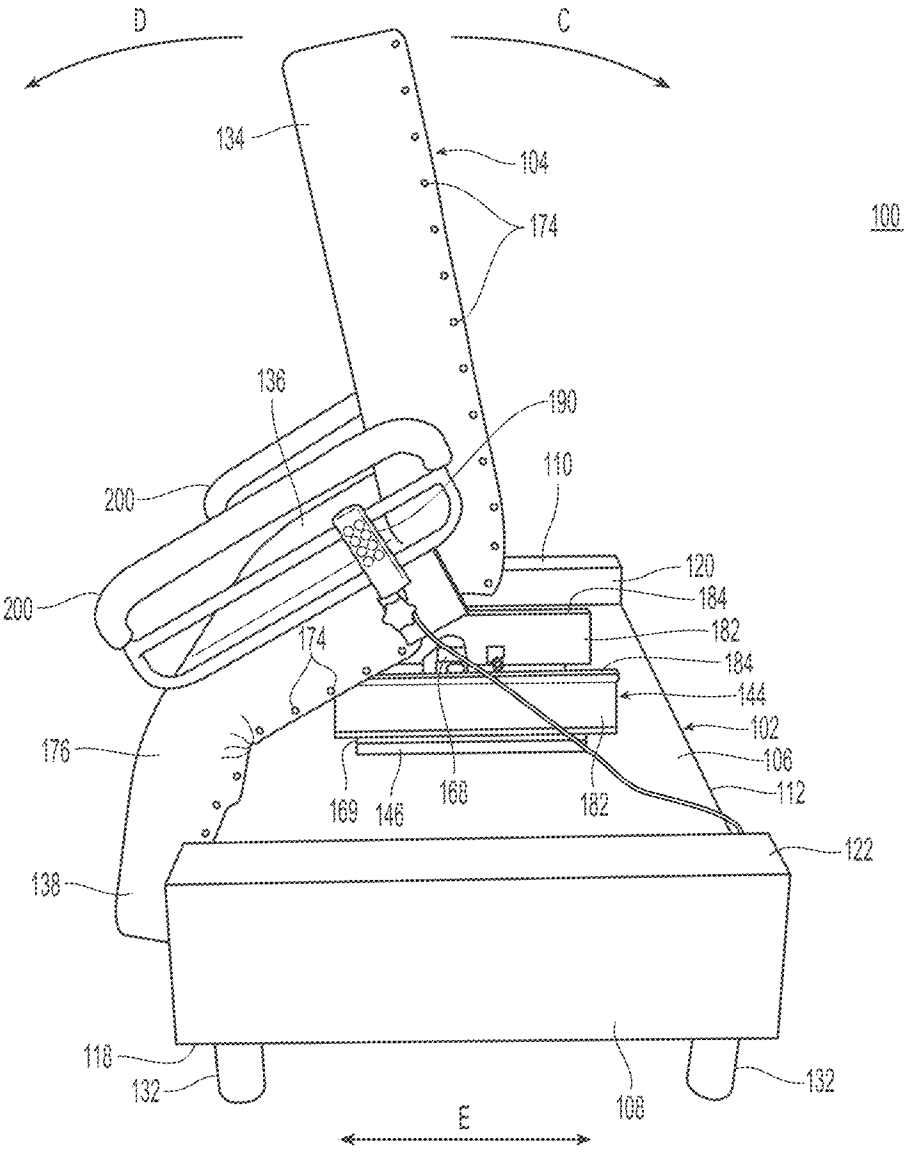
FIG. 8 is a top perspective view from a head end of an embodiment of a rotating and articulating bed with the articulating head portion raised, the articulating bed member rotated 90°, the articulating foot portion lowered past the plane of the horizontal support surface and the articulating bed member pivoted toward the articulating foot portion.
Figure 9:
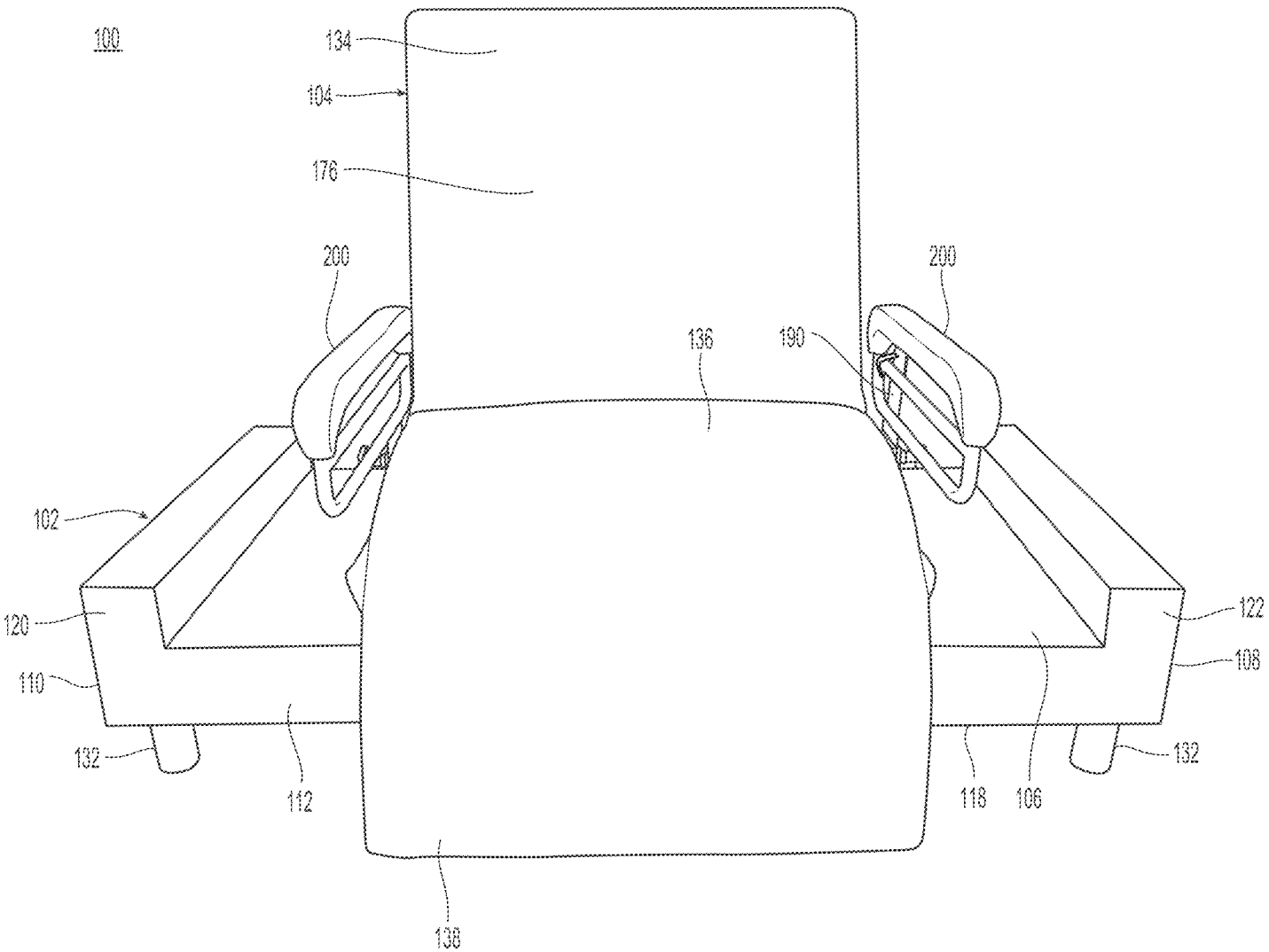
FIG. 9 is a top perspective view from a side of an embodiment of a rotating and articulating bed with the articulating head portion raised, the articulating bed member rotated 90°, the articulating foot portion lowered past the plane of the horizontal support surface and the articulating bed member pivoted toward the articulating foot portion until the articulating foot portion contacts the floor.
Figure 10:
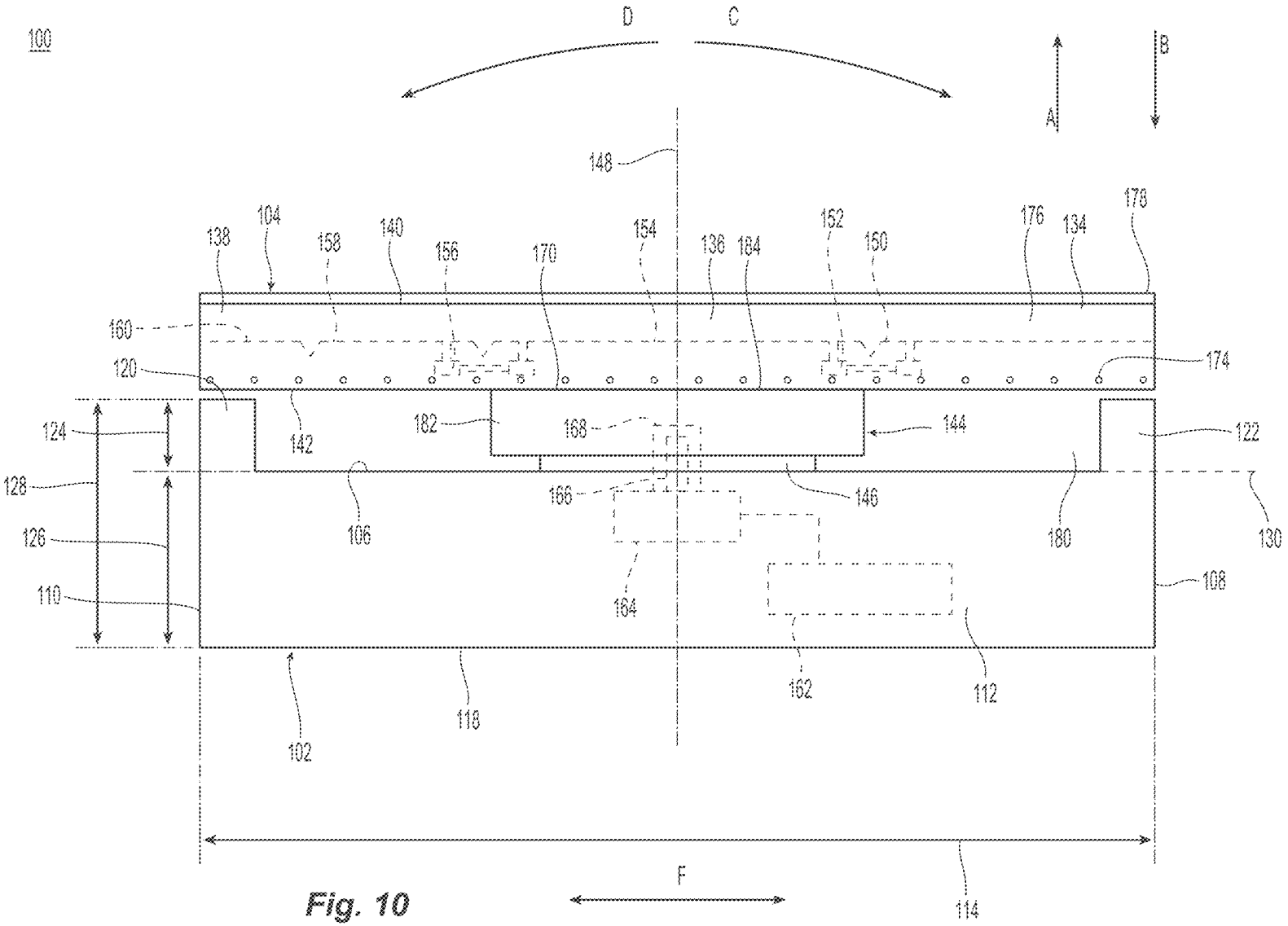
FIG. 10 is a schematic elevational representation of an embodiment of a rotating and articulating bed.

With the articulating head portion, the articulating center portion and the articulating foot portion in either a flat position or an articulated position, the articulating bed member is rotated with respect to the horizontal support surface (FIG. 6). The articulating bed member is rotated through an angle of 90°. The articulating head portion is raised, and the articulating foot portion, which may have been initially raised, is lowered. The articulating foot portion is lowered past the plane of the horizontal support surface (FIG. 7). The articulating bed member is then pivoted or tilted, and in one embodiment pivoted and slid, toward to articulating foot portion and over the side of the fixed bed frame (FIG. 8). In one embodiment, the articulating center portion is pivoted or pivoted and slid with respect to the rotating and pivoting frame. Pivoting and pivoting and sliding movement continues until the articulating foot portion contacts the floor (FIG. 9). As the articulating center portion pivots with respect to the rotating and pivoting frame, the articulating bed member not only positions the occupant toward the side of the rotating and articulating bed in a seated position, but also lifts the occupant to a standing position, as the back of the articulating center portion adjacent the articulating head portion lifts the hips and lower back of the occupant and the articulating head portion tilts forward. Therefore, a person of limited mobility can get out of bed. Reversing these steps allows the person with limited mobility to get into bed and to utilize the articulating features of the rotating and articulating bed.

Figure 16:
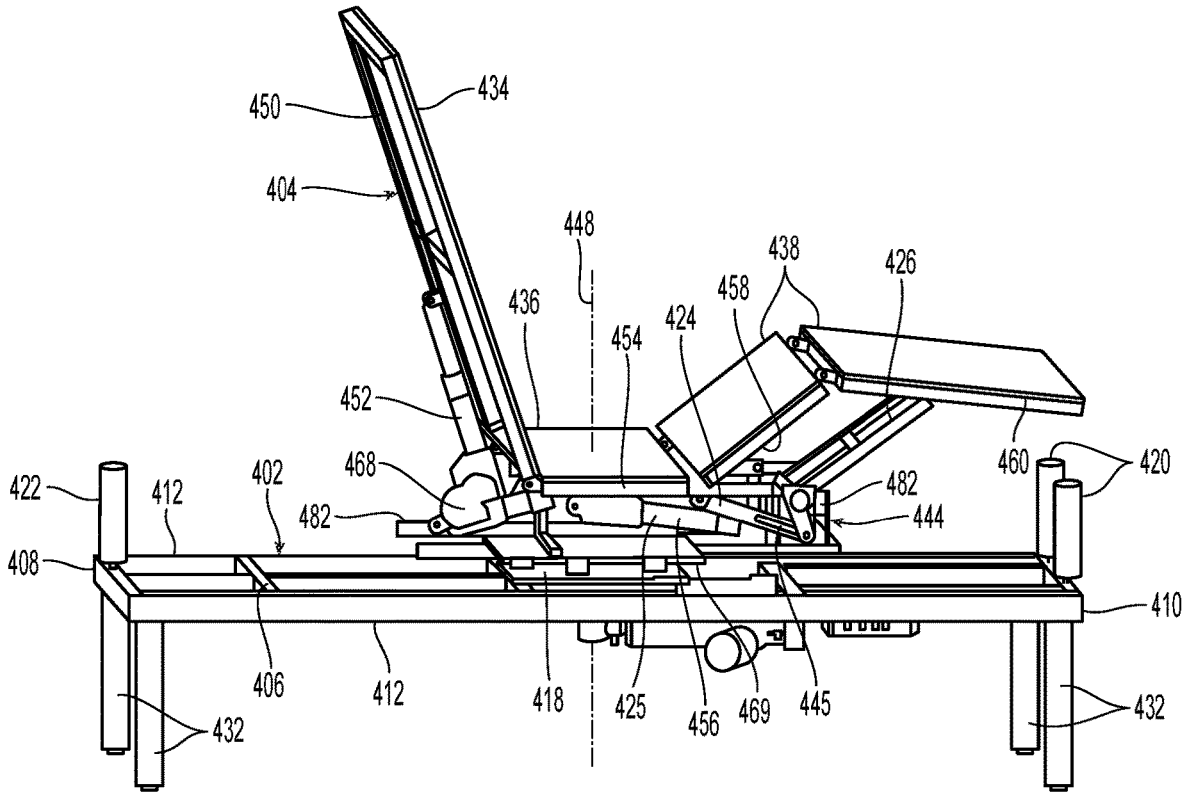
FIG. 16 is a top perspective view of another embodiment of a rotating and articulating bed with the articulating head portion raised and the articulating foot portion raised.
Figure 17:
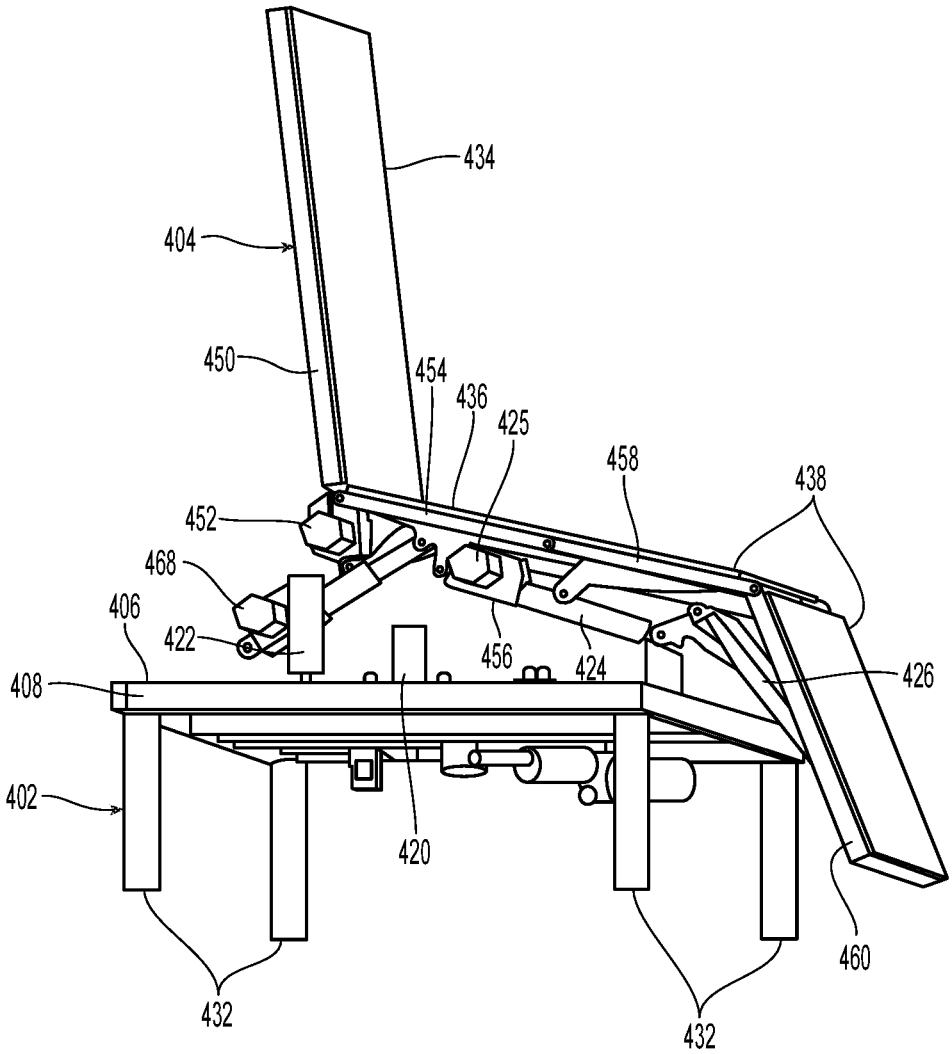
FIG. 17 is a bottom perspective view of an embodiment of a rotating and articulating bed with the articulating bed member rotated, the articulating head portion raised and the articulating foot portion articulated downward.
Figure 18:
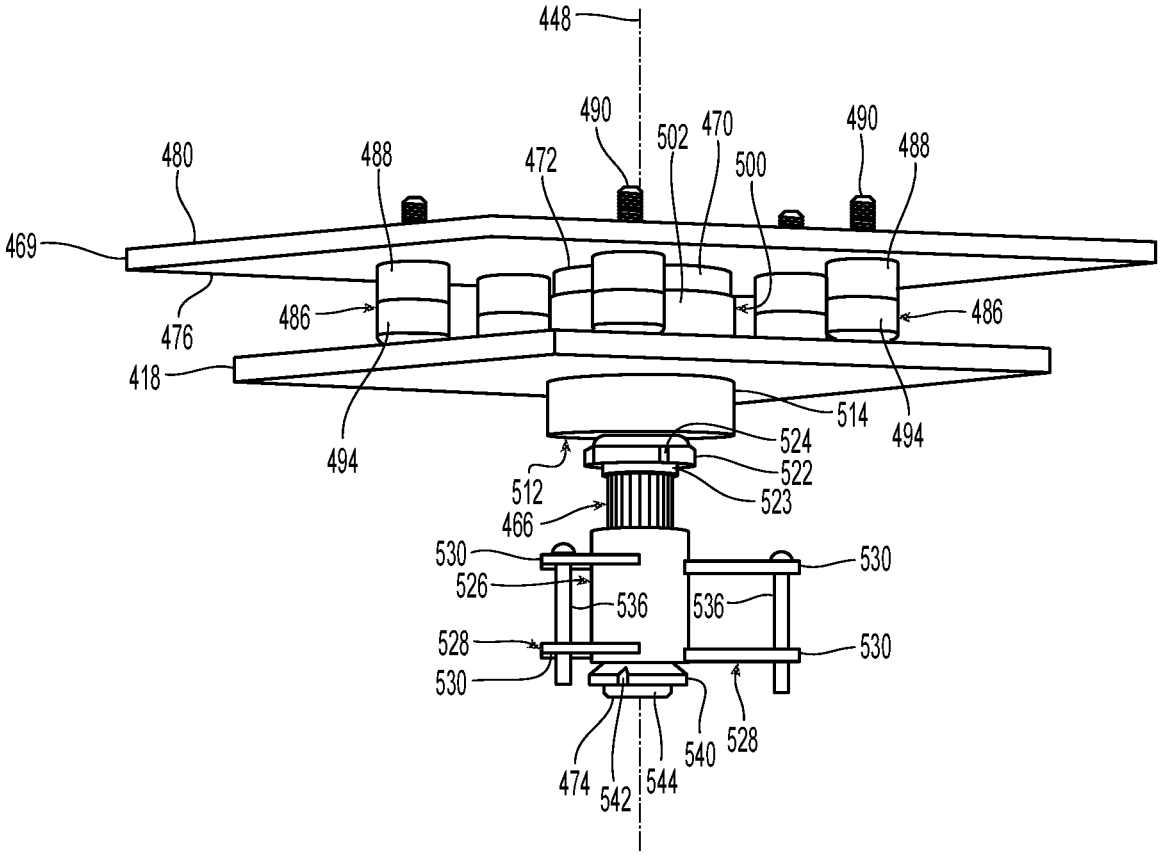
FIG. 18 is a side view of an embodiment of a portion of the rotating and pivoting frame and support plate.
Figure 19:
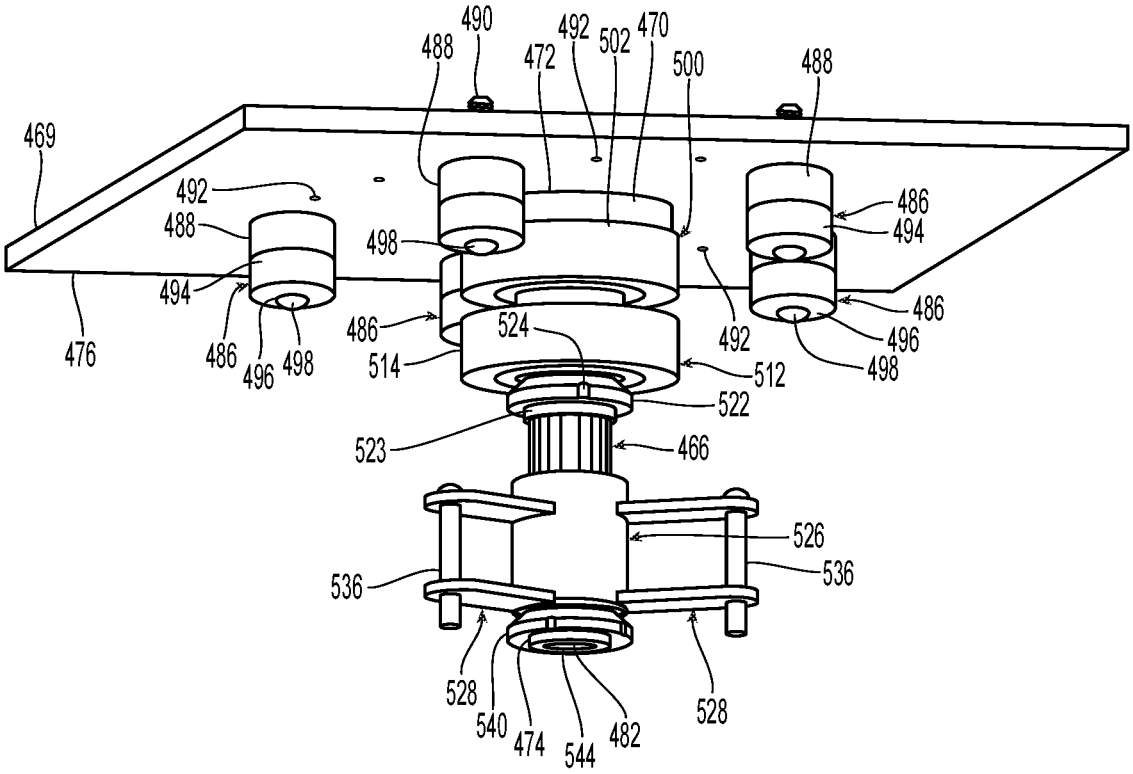
FIG. 19 is a bottom perspective view of a portion of the rotating and pivoting frame.
Figure 20:
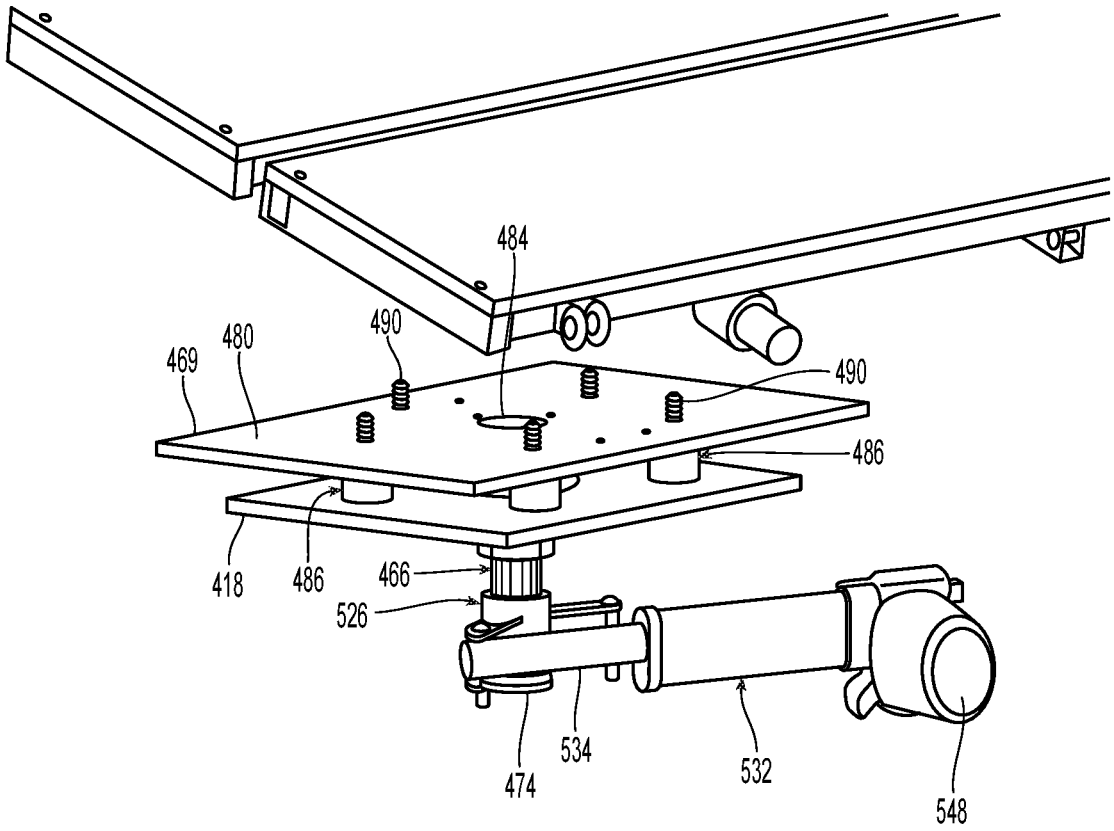
FIG. 20 is a top perspective view of an embodiment of a portion of the rotating and pivoting frame and support plate.
Figure 21:
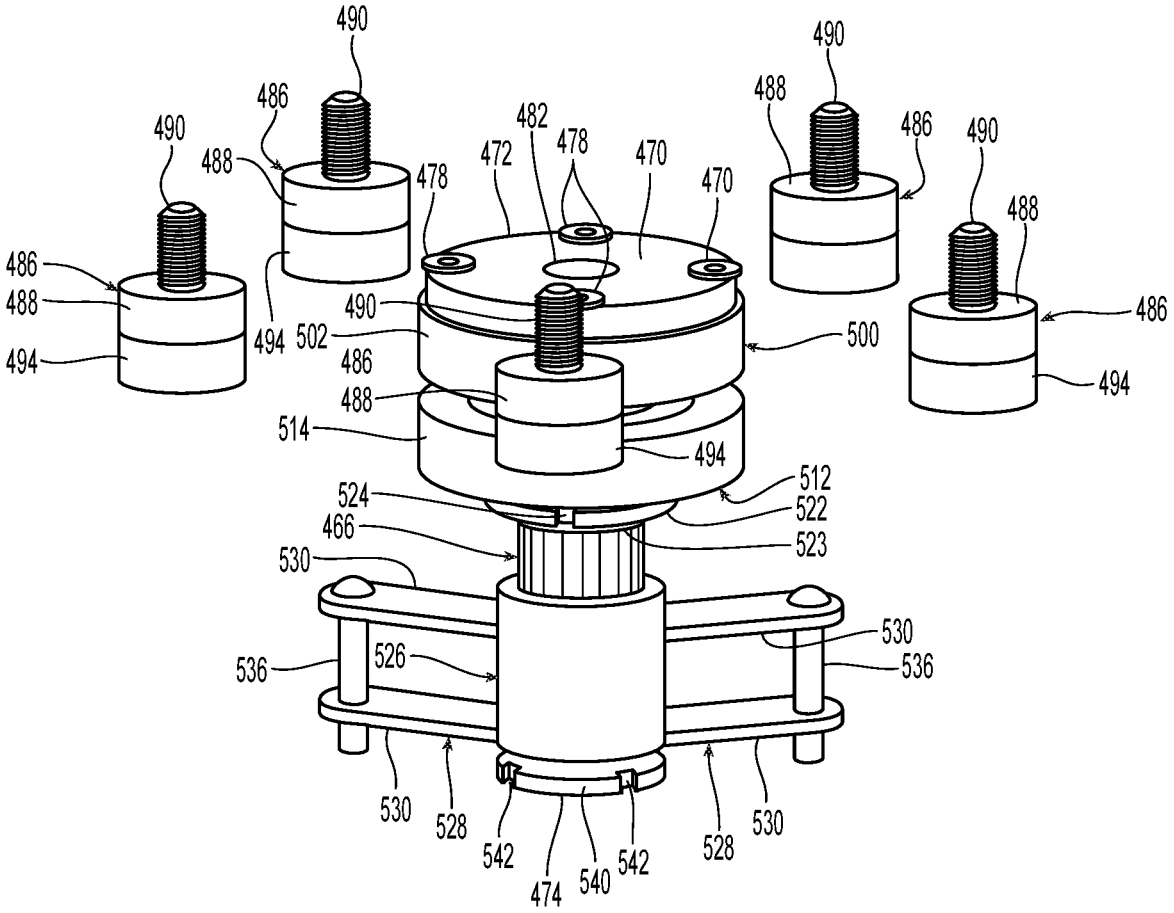
FIG. 21 is a top perspective view of a portion of the rotating and pivoting frame.
Figure 22:
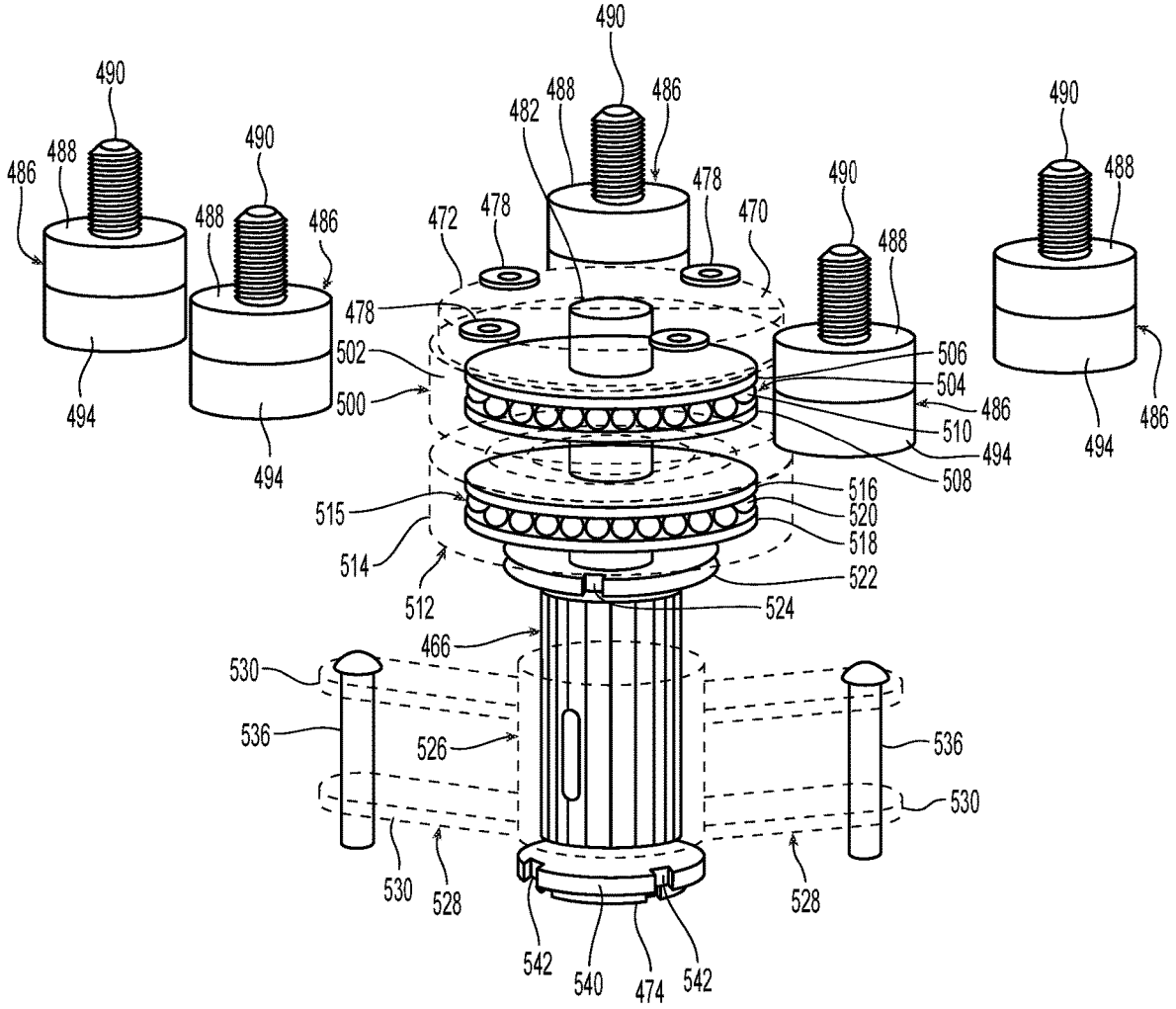
FIG. 22 is a side hidden line view of a portion of the rotating and pivoting frame.

Referring to FIGS. 16-17, another exemplary embodiment of a rotating and articulating bed is illustrated. The framing and support elements of the rotating and articulating bed are illustrated without exterior elements such as padding, upholstery and mattresses. The rotating and articulating bed includes a fixed bed frame 402 and an articulating bed member 404 mounted on the fixed bed frame. Suitable sizes and materials for the rotating and articulating bed include twin, full, queen, king and California king.

The fixed bed frame is constructed from framing materials that include wood, metal, plastics, polymers, composite materials and combinations thereof. In addition, the fixed bed frame is covered with skirting, panels, upholstery and padding. The fixed bed frame has a head end 408, a foot end 410 opposite the head end and a pair of opposing sides 412 extending from the head end to the foot end. The fixed bed frame includes a horizontal support surface 406. In one embodiment, the horizontal support surface includes a support plate 418. The horizontal support plate is supported by the framing members of the fixed bed frame and extends along at least a portion of the width and the length of the horizontal support surface. Suitable methods for attaching the support plate to the horizontal support surface include, but are not limited to, using fasteners and welds. In one embodiment, the support plate is disposed on top of the horizontal support surface. Alternatively, the support plate is integrated into and coplanar with the horizontal support surface. Suitable materials for the support plate include, but are not limited to, wood, metal, plastics, polymers, composite materials and combinations thereof.

In one embodiment, the horizontal support surface extends the entire fixed frame length and the entire fixed frame width. As discussed above, in one embodiment, the fixed frame includes a head end support and a foot end support at either end of the horizontal support surface. In order to provide for the head end support and the foot end support, the first bed frame includes one or more head end support frame members 422 attached to the framing of the fixed bed frame and extending up from the horizontal support surface and one or more foot end support frame members 420 attached to the framing of the fixed bed frame and extending up from the horizontal support surface. In one embodiment, the fixed bed frame includes a plurality of support legs 432 attached to the framing of the fixed bed frame and extending to the floor. For example, the fixed frame includes four support legs, one support leg adjacent each corner of the fixed frame. In one embodiment, the legs are removable. In one embodiment, the legs are extensible.

The articulating bed member 404 includes an articulating head portion 434 and a separate articulating foot portion 438. Suitable arrangements of the articulating head portion and the articulating foot portion and the relative motion, i.e., articulation, between the portions are described above. In general, articulation of the articulating head portion and the articulating foot portion is conducted independent of other adjustments and movements of the articulating bed member including rotation, pivoting and sliding movement of the articulating bed member with respect to the fixed bed frame and the horizontal support surface.

In one embodiment, the articulating bed member includes an articulating center portion 436 disposed between and in communication with the articulating head portion and the articulating foot portion. The articulating head portion and the articulating foot portion articulate with respect to the articulating center portion. Articulation of the articulating head portion, the articulating center portion and the articulating foot portion with respect to each other occurs independent of rotational, pivoting and sliding movement of the articulating bed member with respect to the fixed frame. In one embodiment, the articulating head portion, articulating center portion and articulating foot portion span the fixed frame length from the head end to the foot end and the fixed frame width between the pair of opposing sides.

The articulating bed member includes at least one articulating head portion frame 450, a first articulating foot portion frame 458 and a second articulating foot portion frame 460 pivotally attached to the first articulating foot portion frame. The first and second articulating foot portion frames provide for separate positioning of the upper leg and lower leg portions of the articulating foot portion. The articulating bed member includes at least one articulating center portion frame 454 disposed between the articulating head portion frame and the articulating foot portion frame, e.g., the first articulating foot portion frame 458. All frames include multiple individual frame members.

The articulating center portion frame is pivotally connected to the articulating head portion frame and the articulating foot portion frame. A first actuator assembly 452, i.e., the head portion actuator, is provided between the articulating center portion frame and the articulating heat portion frame. A second actuator assembly 456, i.e., the foot portion actuator, is provided between the articulating center portion frame and the articulating foot portion frame. The actuator assemblies include the actuators, motors, push rods and frame members, e.g., cross frame members, braces and mounting brackets, to provide the desired attachment of the actuators, pivoting of the actuators with respect to frame members, articulation among the articulating head portion, the articulation center portion and the articulating foot portion and translation of the linear motion of the actuator into the desired range of pivoting motion among of the articulating head portion, the articulation center portion and the articulating foot portion.

In one embodiment, the articulating bed frame includes a rotating and pivoting frame 444 or rotating and pivoting frame assembly. The rotating and pivoting frame is mounted on the horizontal support surface and is in communication with the articulating head portion and the articulating foot portion of the articulating bed member. In one embodiment, the rotating and pivoting frame is attached to or in contact with the articulating center portion of the articulating bed member either directly or through one or more additional frame elements or one or more of the actuator assemblies. In general, the rotating and pivoting frame is in contact with the frame members of at least one of the articulating head portion, the articulating foot portions and the articulating center portion. In one embodiment, the rotating and pivoting frame is positioned on or above the support plate 418 mounted to the horizontal support surface.

In one embodiment, the rotating and pivoting frame is in communication with and attached to at least one of the articulating head portion and the articulating foot portion. In another embodiment, the rotating and pivoting frame is in communication with and connected to the articulating center portion. In one embodiment, connection to the articulating head portion, the articulating center portion or the articulating foot portion is connection to the articulating head portion frame, the articulating center portion frame or the articulating foot portion frame.

The rotating and pivoting frame includes a plurality of individual frame members 482 that are connected together, for example to form square frames and a box frame. The individual frame members can also include "I" beams and gussets that provide the desired strength and rigidity to the rotating and pivoting frame. The individual frame members provide support for all components of the rotating and pivoting frame. In addition, the frame members are sufficient to support the articulating bed member. In one embodiment, one or more frame members in the plurality of frame members are connected to components of the second actuator assembly 456, i.e., the foot portion actuator. For example, one or more frame members are attached to a first connecting arm 424 that is in communication with the first articulating foot portion frame 458 and the extendable arm of the linear actuator 425 in the second actuator assembly. The motor or drive end of the linear actuator is pivotally attached to the articulating center portion frame.

In one embodiment, one or more frame members 482 of the rotating and pivoting frame are in communication with a second articulating foot portion frame support assembly 426 that is in communication with the second articulating foot portion frame 460 and the extendable arm of the linear actuator in the second actuator assembly. For example, one or more frame members 482 are pivotally attached to the second articulating foot portion frame support assembly 426. In addition, the second articulating foot portion frame support assembly 426 is pivotally or rotatably attached to the extendable arm of the linear actuator 425, for example, at a common point of attachment with the first connecting arm 424. In one embodiment, the first connecting arm is not attached to the frame members 482 but is connected to the linear actuator 425 and the second articulating foot portion frame support assembly 426. In one embodiment, the first connecting arm includes a slot 445 running along the length of the first connecting arm to provide for sliding movement of the first connecting arm with respect to the point of attachment with the second articulating foot portion frame support assembly 426 and the extendable arm of the linear actuator 425. In one embodiment, the slot allows the extendable arm of the linear actuator 425 to pivot the second articulating foot portion frame downward without moving or pivoting the first articulating foot portion frame 458.

The actuator or motor portion of the second actuator assembly is preferably connected to the articulating center portion frame 454; however, this actuator could also be connected to the plurality of frame members of the rotating and pivoting frame. This arrangement provides operational support between the plurality of frame members of the rotating and pivoting frame and the articulating bed member as well as the relative articulation and positioning between the first articulating foot portion frame and the second articulating foot portion frame.

In one embodiment, the rotating and pivoting frame includes at least one bearing plate 469 attached to one or more of the plurality of frame member of the rotating and pivoting frame. In one embodiment, the frame members are secured to the bearing plate, for example, by welds or using a plurality of fasteners such as bolts or screws. Suitable materials for the bearing plate include, but are not limited to, wood, metal, plastics, polymers, composite materials and combinations thereof. Therefore, the bearing plate supports all rotating and pivoting frame members. The bearing plate is disposed between the frame member of the rotating and pivoting frame and the horizontal support surface. Preferably, the bearing plate is disposed between the frame member of the rotating and pivoting frame and the support plate. Therefore, the bearing plate and support plate face each other. The bearing plate and support plate are spaced from each other in the vertical direction to define a gap of up to about one inch (25.4 mm). In one embodiment, the bearing plate and support plate are the same size. As illustrated, the bearing plate is larger than the support plate. In one embodiment, the bearing plate and the support plate are constructed from the same material. Suitable thicknesses for the bearing plate and support plate are up to about 0.6 inches (15 mm). Rotation of the bearing plate with respect to the support plate rotates the plurality of frame members and the articulating bed member.

The rotating and pivoting frame 444 is rotatable with respect to the horizontal support surface or the support plate around a vertical axis 448 passing through and perpendicular to the horizontal support surface, the support plate and the bearing plate. The rotating and pivoting frame also provides pivoting movement of the articulating bed member with respect to the horizontal support surface to tilt the articulating bed member toward at least one of the articulating head portion and the articulating foot portion. In one embodiment, the rotating and pivoting frame pivots the articulating center portion or the articulating center portion frame backwards towards the articulating head portion or forward towards the articulating foot portion. In one embodiment, the rotating and pivoting frame is pivotally connected to the articulating center portion or the articulating center portion frame.

To provide for pivoting movement of the articulating bed member, the rotating and pivoting frame includes at least one pivot actuator 468. Preferably, the pivot actuator is a linear actuator. In one embodiment, the pivot actuator is disposed between and pivotally attached to one or more of the plurality of frame members of the rotating and pivoting frame or mounting arms and mounting brackets attached to the frame members and the articulating center portion frame. Movement of the pivot actuator, and in particular the push rod or extendable arm of the pivot actuator, produces lifting and pivoting movement of the articulating center portion. In one embodiment, the rotating and pivoting frame only provides for rotational movement and not pivoting movement. In this embodiment, the pivot actuator and associated structural members are not included; however, the structures that provide for rotational movement are included.

Referring now to FIGS. 18-22, the rotating and pivoting frame includes a rotating drive shaft 466 extending through the support plate 418 and centered on the vertical axis 448. In one embodiment, the rotating drive shaft is a cylindrical shaft that is concentric with the vertical axis. The rotating drive shaft includes a mounting flange 470 disposed on a first end 472 of the rotating drive shaft. The rotating drive shaft also includes a second end 474 opposite the first end. The support plate is disposed between the first end and the second end of the rotating drive shaft, i.e., the rotating drive shaft passes through the support plate. In addition, the rotating drive shaft including the mounting flange is located below the bearing plate 469. In one embodiment, the mounting flange is in contact with the bearing plate and, in particular, the bearing plate bottom surface 476. In one embodiment, the mounting flange is secured to the bottom surface of the bearing plate using a plurality of fasteners 478 passing through the bearing plate. Therefore, the fasteners in the plurality of fasteners are accessible from a top surface 480 of the bearing plate. As illustrated, the mounting flange is secured to the bearing plate using four fasteners. Suitable fasteners include, but are not limited to, threaded fasteners such as screws and bolts.

In one embodiment, the rotating drive shaft is hollow and includes a passage 482 extending completely through the rotating drive shaft from the first end and mounting flange to the second end. The passage at the first end of the rotating drive shaft is aligned with a hole 484 in the bearing plate. The passage and aligned hole in the bearing plate provide a conduit to route wiring including power cables and control wiring for the actuators and other components of the rotating and articulating bed from below or within the fixed bed frame into the rotating and pivoting frame and to the articulating bed member. By passing wiring through the passage in the rotating drive shaft, the wiring will not rotate or twist. In addition, the wiring does to contact or interfere with the motion of rotating components.

The rotating and pivoting frame includes a plurality of discrete bearings 486 disposed between the bearing plate and the horizontal support surface. The rotating and pivoting frame is rotatable with respect to the horizontal support surface on the plurality of discrete bearings around the vertical axis 448. Each discrete bearing is separate from, spaced from and independent of the other discrete bearings. Therefore, each discrete bearing is positioned on the bearing plate, attached to the bearing plate and removed from the bearing plate independent of all other discrete bearings. In one embodiment, each discrete bearing includes a housing 488 mounted to the bearing plate. In one embodiment, the housing is configured as a flange mounted to the bottom surface of the bearing plate. Preferably, the housing includes a threaded stem 490 that is inserted through or threaded into one of a plurality of holes 492 in the bearing plate. In one embodiment, the number of holes and the location of the holes in the bearing plate provide for the attachment of additional discrete bearings or the relocation or reconfiguration of the discrete bearings.

Each discrete bearing also includes a cover 494 attached to the housing and having a circular opening 496. The cover can be removable or fixed. A main ball 498 is disposed between and rotatable within the housing and the cover. The main ball extends through the circular opening toward the horizontal support surface. In one embodiment, a plurality of additional smaller balls is provided between the main ball and at least one of the housing and the cover. The additional smaller balls facilitate smoother rotation of the main ball within the housing and the cover. In one embodiment, the discrete bearings in the plurality of discrete bearings are disposed between the bearing plate and the support plate, and each main ball is in contact with the support plate. Therefore, each main ball rotates as the discrete bearing, which is attached to the bearing plate, moves along the support plate. This provides for rotation between the bearing plate, i.e., the rotating and pivoting frame, and the support plate, i.e., the horizontal surface of the fixed frame.

The number and arrangement of discrete bearings between the bearing plate and the horizontal support surface are varied. Suitable numbers of discrete bearings include at least three discrete bearings, at least four discrete bearings, at least five discrete bearings and more that five discrete bearings. In one embodiment, the rotating and pivoting frame includes five discrete bearings. Each discrete bearing is spaced a given distance from the vertical axis of rotation and therefore the rotating drive shaft. In one embodiment, this given distance is sufficient to support the forces and loads applied to the bearing plate from the rotating and pivoting frame and the articulating frame member, which are cantilevered from the vertical axis of rotation and the rotating drive shaft. Therefore, placing discrete bearings between the bearing plate and support surface at the given distance prevents tilting between the bearing plate and the support surface.

In one embodiment, each one of the plurality of discrete bearings is spaced along the bearing plate an equal distance from the vertical axis. Alternatively, the discrete bearings in the plurality of discrete bearings are spaced at two or more different distances from the vertical axis. In one embodiment, the discrete bearings in the plurality of bearings are each spaced a unique distance from the vertical axis. In one embodiment, the discrete bearings in the plurality of discrete bearings are disposed along a common arc or circle centered on the vertical axis. The discrete bearings can be spaced evenly or uniformly from each other along the arc or circle. For example, the plurality of discrete bearings can contain five discrete bearings spaced equally around a circle centered on the vertical axis. Alternatively, the plurality of discrete bearings includes four discrete bearings, each bearing located on the corner of a square centered on the vertical axis. In one embodiment, the plurality of discrete bearings includes three discrete bearings arranged in triangle, for example an equilateral triangle, centered around the vertical axis.

In one embodiment the discrete bearings in the plurality of discrete bearings are arranged in two or more concentric circles centered on the vertical axis. Each concentric circle can contain at least one or two or more discrete bearings. In addition to circles, the discrete bearings can be arranged along oblong shapes. The bearings in the discrete bearings can also be arranged in other shapes, for example, along radial lines extending from the vertical axis, including straight lines and curved lines.

As the mounting flange of the rotating drive shaft is attached to the bearing plate, loads placed on the bearing plate translate into axial loads along the rotating drive shaft. While the rotating and pivoting frame can include just the plurality of discrete bearings between the bearing plate and the support plate, in one embodiment one or more thrust bearings are included in the rotating and pivoting frame to accommodate the axial loads along the rotating drive shaft while providing for rotation of the rotating drive shaft. In one embodiment, the rotating and pivoting frame includes an upper bearing assembly 500. The upper bearing assembly includes an upper bearing housing 502 disposed between the mounting flange and the support plate. An upper bearing assembly thrust ball bearing 504 is disposed within the housing. The rotating drive shaft passes through the upper bearing assembly and the thrust ball bearing.

The thrust ball bearing includes an upper bearing ring 506 in contact with the mounting flange and a lower bearing ring 508 in contact with the housing. Therefore, the thrust ball bearing is spaced from the support plate by the housing. In one embodiment, the lower bearing ring is in contact with the support plate. A plurality of ball bearings 510 is disposed between the upper bearing ring and the lower bearing ring. The rotating drive shaft is in contact with the plurality of ball bearings, and the rotating drive shaft and the mounting flange rotate with respect to the upper bearing assembly. The support plate does not rotate with respect to the upper bearing assembly.

In another embodiment, the rotating and pivoting frame includes a lower bearing assembly 512. The rotating and pivoting frame can include only the upper bearing assembly, only the lower bearing assembly or both the upper bearing assembly and the lower bearing assembly. In one embodiment, the upper bearing assembly is identical to the lower bearing assembly. The lower bearing assembly includes a lower bearing housing 514 disposed between the support plate and the second end of the rotating drive shaft. Therefore, the lower bearing assembly is located below the support plate and horizontal support surface and within the fixed frame.

The lower bearing assembly includes a lower bearing assembly thrust ball bearing 515 disposed within the lower bearing housing. The rotating drive shaft passes through the thrust ball bearing. The thrust ball bearing includes an upper bearing ring 516 in contact with the housing. In one embodiment, the upper bearing ring is in contact with bottom surface of the support plate. The thrust ball bearing also includes a lower bearing ring 518 and a plurality of ball bearings 520 disposed between the upper bearing ring and the lower bearing ring. The rotating drive shaft is in contact with the plurality of ball bearings.

In one embodiment, the rotating and pivoting frame further includes a first or upper threaded locking ring 522 threaded onto the rotating drive shaft between the second end of the rotating drive shaft and the lower bearing assembly. The upper threaded locking ring is threaded onto a first threaded portion 523 of the rotating drive shaft. The upper threaded locking ring is in contact with the lower bearing assembly. In one embodiment, the upper threaded locking ring is in contact with the lower bearing ring of the lower bearing assembly to provide for rotation of the rotating drive shaft within the thrust ball bearing. The upper threaded locking ring secures the rotating and pivoting frame to the support plate and holds the lower bearing assembly against the bottom surface of the support plate. Removal of the upper threaded locking right provides access to the bearing assemblies and removal of the rotating and pivoting frame from the fixed frame.

In one embodiment, a wrench such as a spanner wrench is used to remove the upper threaded locking ring. The upper threaded locking ring includes a pair of exterior notches 524 engaged by tangs in the spanner wrench to facilitate turning and removal of the upper threaded locking ring. In one embodiment, the spanner wrench is configured specifically for the arrangement of the notches to provide for easy removal of the threaded locking ring while preventing removal of the threaded locking ring with conventional wrenches or tools.

In one embodiment, the rotating and pivoting frame includes a removable drive collar 526 disposed over the rotating drive shaft adjacent the second end. The drive collar is removable and can be slid onto the rotating drive shaft from the second end. While the drive collar can move axially along the rotating drive shaft, the drive collar and rotating drive shaft are configured to engage each other such that drive collar does not rotate relative to the rotating drive shaft. Therefore, rotation of the drive collar rotates the rotating drive shaft. In one embodiment, a pin can be inserted through the drive collar and rotating drive shaft. Alternatively, the rotating drive shaft along a portion of its length adjacent the second end includes a shape, grooves or ridges that engage a mating shape, ridges or grooves on an interior surface of the drive collar. This engagement translates rotational motion of the drive collar to the rotating drive shaft.

The rotating and pivoting frame also includes a second lower threaded locking ring 540 threaded onto the rotating drive shaft at the second end of the rotating drive shaft. The lower threaded locking ring is threaded onto a second threaded portion 544 of the rotating drive shaft that extends along a portion of the length of the rotating drive shaft from the second end. The lower threaded locking ring is in contact with the drive collar. The lower threaded locking ring holds and secures the drive collar on the rotating drive shaft. Removal of the lower threaded locking ring provides removal of the drive collar. In one embodiment, a wrench such as a spanner wrench is used to remove the lower threaded locking ring. The lower threaded locking ring includes a pair of exterior notches 544 engaged by tangs in the spanner wrench to facilitate turning and removal of the lower threaded locking ring. In one embodiment, the spanner wrench is configured specifically for the arrangement of the notches to provide for easy removal of the threaded locking ring while preventing removal of the threaded locking ring with conventional wrenches or tools.

In one embodiment, the drive collar includes a pair of arm assemblies 528 extending out from the drive collar. In another embodiment, the drive collar includes a pair of opposing arms. Each arm assembly extends radially out from the drive collar and vertical axis. In one embodiment, the arm assemblies are diametrically opposed. Alternatively, the arm assemblies extend out from the drive collar along separate radiuses that define an included angle of from about 90° to about 180°. In one embodiment, each arm assembly includes to pair of spaced arms 530, i.e., separate arms spaced from each other axially along the length of the rotating drive shaft and drive collar. The spaced arms create or define a bracket. The rotating and pivoting frame includes a rotation actuator 532 in contact with the fixed frame and one of the arm assemblies. As illustrated, therefore, the rotating and pivoting bed includes four actuators, a head portion actuator, a foot portion actuator, a rotation actuator and a pivot actuator. In one embodiment, all four actuators are linear actuators. In one embodiment, all four actuators are identical actuators.

In one embodiment, the push rod or extensible end 534 of the rotation actuator, which is a linear actuator, is disposed between the spaced arms of one of the arm assemblies. A set pin 536 passes through holes in each one of spaced arms and, when the rotation actuator is attached to a given arm assembly, the end of the extensible rod to secure the extensible rod in the bracket formed by the spaced arms. The extensible arm can rotate with respect to the set pin.

Figure 23:
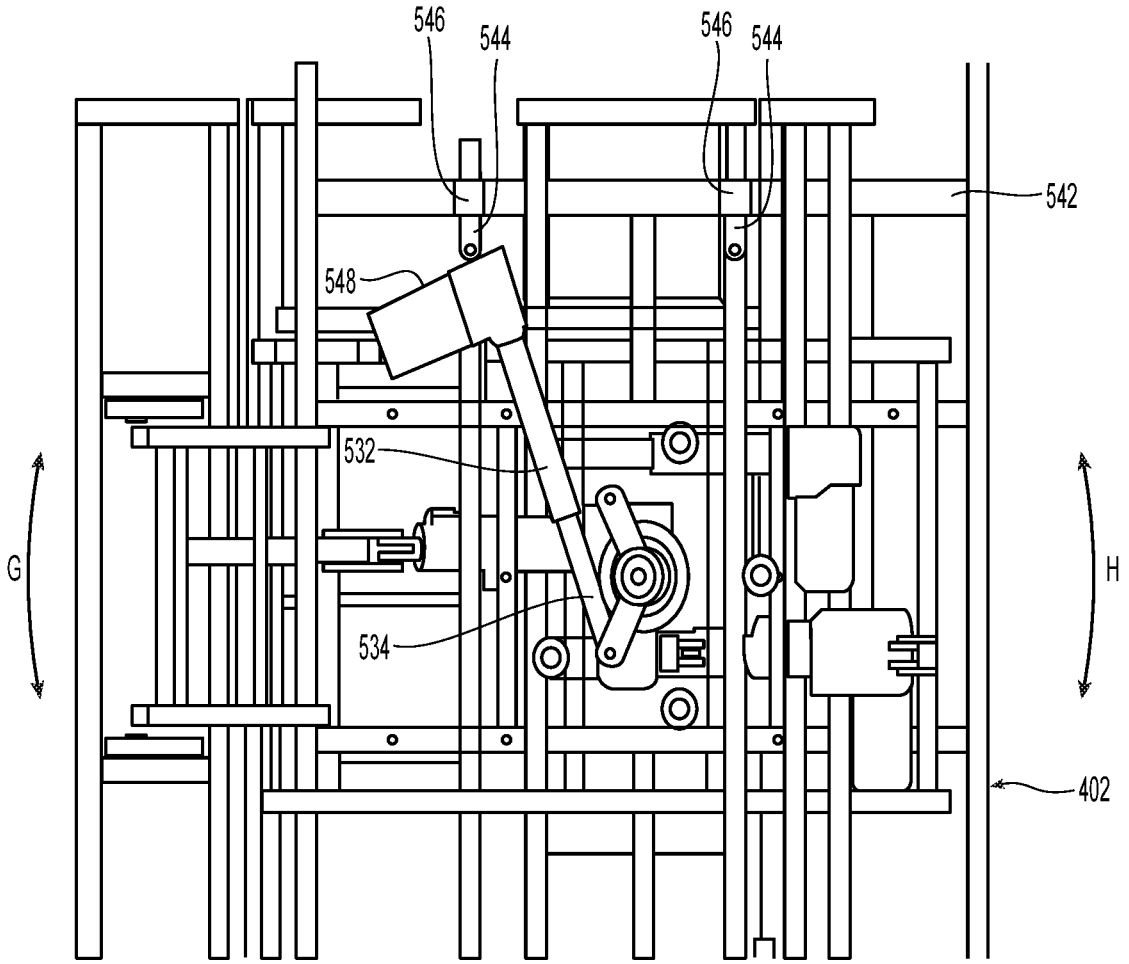
FIG. 23 is a bottom view of a portion of the rotating and articulating bed with the articulating bed member rotated, the articulating head portion raised and the articulating foot portion articulated downward.
Figure 24:
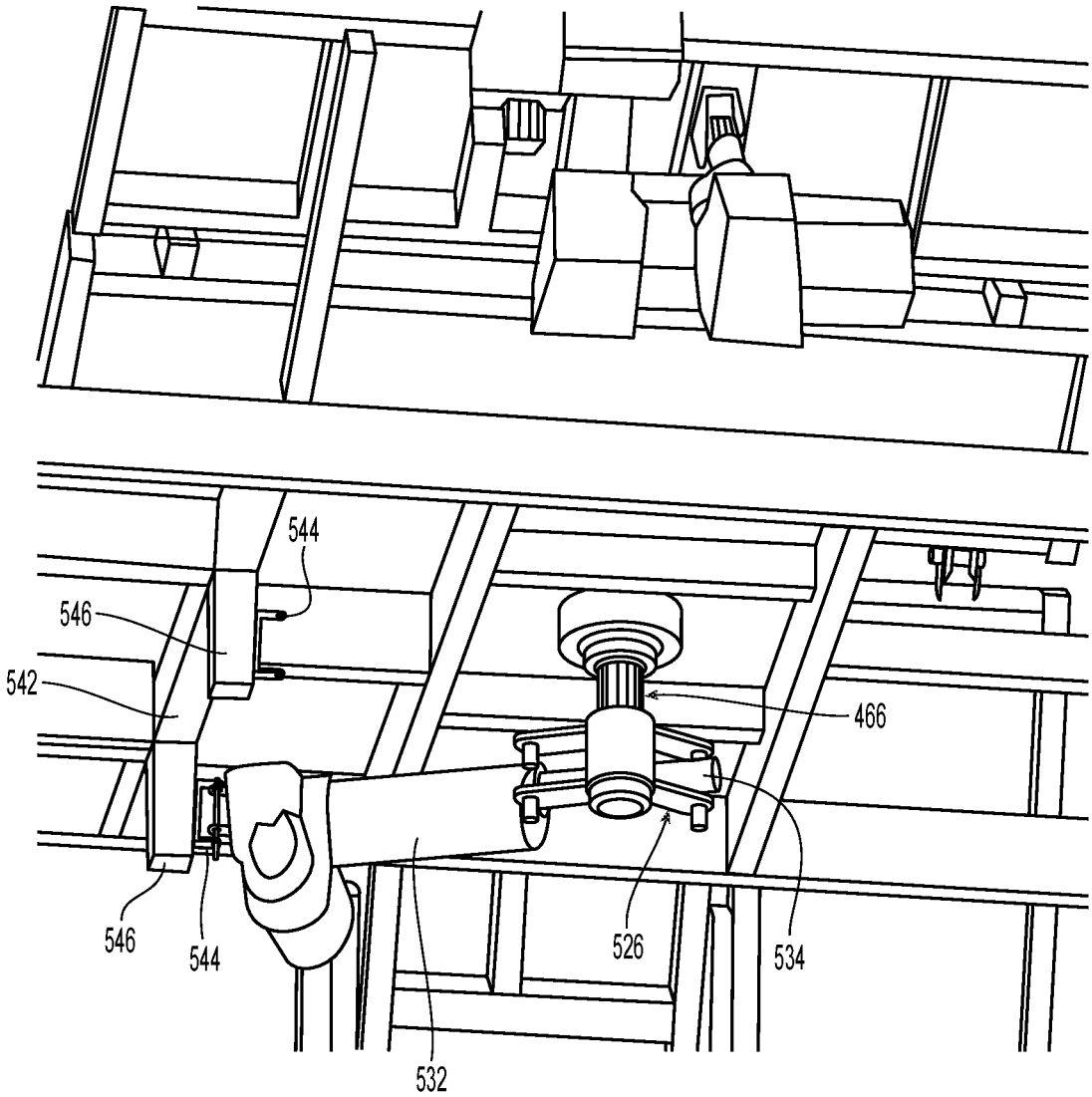
FIG. 24 is a bottom perspective view of a portion of the rotating and articulating bed with the articulating bed member rotated, the articulating head portion raised and the articulating foot portion articulated downward.

Referring now to FIGS. 23 and 24, the fixed drive end 548 of the rotation actuator 532 is pivotally attached to one of two actuator mounting brackets 544 attached to vertical frame members 546 extending down from an internal cross frame member 542 of the fixed frame 402. In one embodiment, the actuator mounting bracket is a "U" shaped bracket, and the fixed drive or motor end of the rotation actuator is held in the bracket with a set pin. Therefore, the rotation actuator can rotate or pivot within the fixed frame mounting bracket to which it is attached. The use of set pins to secure the rotation actuator in the fixed frame mounting brackets and between the spaced arms of the drive collar provides for ease of attachment of the rotation actuator to the fixed frame and drive collar. This attachment can be made after the bed is assembled and set-up and can be easily changed. Selection of the fixed frame mounting bracket and spaced arms on which the rotation actuator is mounted determines the direction of rotation of the rotating and pivoting frame.

As illustrated in FIG. 23, attachment of the rotation actuator to the fixed frame mounting bracket and spaced arms generally to the left of the vertical axis and rotating drive shaft produces rotation as indicated by arrow G. Attachment of the rotation actuator to the other fixed frame mounting bracket and spaced arms generally to the right of the vertical axis and rotating drive shaft produces rotation as indicated by arrow H. Therefore, the rotating and pivoting frame is rotatable around the vertical axis in a first direction of rotation (Arrow G) through an angle up to about 90° and in a second direction of rotation (Arrow H) through an angle up to about 90°. The first direction of rotation is opposite the second direction of rotation.

In one embodiment, removal and attachment of the rotation actuator occurs when rotating drive shaft is in the unrotated position, i.e., the articulating bed member is aligned with the fixed frame. In this position, each set of spaced arms extends from an opposite side of the drive collar towards one of the sides of the fixed frame. However, both sets of spaced arms extend toward the same end of the bed. Therefore, the position of attachment, i.e., the location of the set pins, for both sets of spaced arms is between the vertical axis and rotating drive shaft and the actuator mounting brackets 544 attached to vertical frame members 546. In one embodiment, the rotations actuator is disposed between the vertical axis and the foot end of the rotating and articulating bed.

Although the features and elements of the present exemplary embodiments are described in the embodiments in particular combinations, each feature or element can be used alone without the other features and elements of the embodiments or in various combinations with or without other features and elements disclosed herein. Any methods or flowcharts provided in the present application may be implemented in a computer program, software, or firmware tangibly embodied in a computer-readable storage medium for execution by a dedicated computer or a processor.

This written description uses examples of the subject matter disclosed to enable any person skilled in the art to practice the same, including making and using any devices or systems and performing any incorporated methods. The patentable scope of the subject matter is defined by the claims, and may include other examples that occur to those skilled in the art. Such other examples are intended to be within the scope of the claims.

What is claimed is:

1. A rotating and articulating bed comprising:
- a fixed bed frame comprising a horizontal support surface;
- an articulating bed member; and
- a rotating and pivoting frame mounted on the horizontal support surface and in communication with the articulating bed member, the rotating and pivoting frame comprising:
  - a bearing plate comprising a bottom surface having an area; and
  - a plurality of discrete bearings within the area of the bearing plate and disposed between the bearing plate and the horizontal support surface, the rotating and pivoting frame rotatable with respect to the horizontal support surface on the plurality of discrete bearings around a vertical axis passing through the horizontal support surface.

2. The rotating and articulating bed of claim 1, wherein each discrete bearing comprises:
- a housing mounted to the bearing plate;
- a cover attached to the housing and having a circular opening; and
- a main ball disposed between the housing and the cover, the main ball extending through the circular opening toward the horizontal support surface.

3. The rotating and articulating bed of claim 1, wherein each one of the plurality of discrete bearings is spaced along the bearing plate an equal distance from the vertical axis.

4. The rotating and articulating bed of claim 1, wherein the plurality of discrete bearings comprises five discrete bearings.

5. The rotating and articulating bed of claim 4, wherein the five discrete bearings are spaced equally around a circle centered on the vertical axis.

6. The rotating and articulating bed of claim 1, wherein the horizontal support surface comprises a support plate, the plurality of discrete bearings disposed between the bearing plate and the support plate.

7. The rotating and articulating bed of claim 6, wherein each discrete bearing comprises a main ball, each main ball in contact with the support plate.

8. The rotating and articulating bed of claim 6, wherein the rotating and pivoting frame further comprises:
- a rotating drive shaft extending through the support plate and centered on the vertical axis, the rotating drive shaft comprising a mounting flange disposed on a first end of the rotating drive shaft, the mounting flange in contact with the bearing plate; and
- an upper bearing assembly comprising:
  - an upper bearing housing disposed between the mounting flange and the support plate; and
  - a thrust ball bearing disposed within the housing, the rotating drive shaft passing through the thrust ball bearing.

9. The rotating and articulating bed of claim 8, wherein the thrust ball bearing comprises:
- an upper bearing ring in contact with the mounting flange;
- a lower bearing ring in contact with the housing; and
- a plurality of ball bearings disposed between the upper bearing ring and the lower bearing ring, the rotating drive shaft in contact with the plurality of ball bearings.

10. The rotating and articulating bed of claim 6, wherein the rotating and pivoting frame further comprises:
- a rotating drive shaft extending through the support plate and centered on the vertical axis, the rotating drive shaft comprising:
  - a mounting flange disposed on a first end of the rotating drive shaft, the mounting flange in contact with the bearing plate; and
  - a second end opposite the first end, the support plate disposed between the first end and the second end; and
- a lower bearing assembly comprising:
  - a lower bearing housing disposed between the support plate and the second end of the rotating drive shaft; and
  - a thrust ball bearing disposed within the lower bearing housing, the rotating drive shaft passing through the thrust ball bearing.

11. The rotating and articulating bed of claim 10, wherein the thrust ball bearing comprises:
- an upper bearing ring in contact with the housing;
- a lower bearing ring; and
- a plurality of ball bearings disposed between the upper bearing ring and the lower bearing ring, the rotating drive shaft in contact with the plurality of ball bearings.

12. The rotating and articulating bed of claim 11, wherein the rotating and pivoting frame further comprises a threaded locking ring threaded onto the rotating drive shaft between the second end of the rotating drive shaft and the lower bearing assembly, the threaded locking ring in contact with the lower bearing ring.

13. The rotating and articulating bed of claim 6, wherein the rotating and pivoting frame further comprises:
- a rotating drive shaft extending through the support plate and centered on the vertical axis, the rotating drive shaft comprising:
  - a mounting flange disposed on a first end of the rotating drive shaft, the mounting flange in contact with the bearing plate; and a second end opposite the first end, the support plate disposed between the first end and the second end; and a removable drive collar disposed over the rotating drive shaft adjacent the second end such that rotation of the drive collar rotates the rotating drive shaft, the drive collar comprising a pair of arm assemblies extending out from the drive collar.

14. The rotating and articulating bed of claim 13, wherein the rotating and pivoting frame further comprises a rotation actuator in contact with the fixed frame and one of the arm assemblies.

15. The rotating and articulating bed of claim 13, wherein the rotating and pivoting frame further comprises a threaded locking ring threaded onto the rotating drive shaft at the second end of the rotating drive shaft, the threaded locking ring in contact with drive collar.

16. The rotating and articulating bed of claim 1, wherein:

the articulating bed member comprises:

an articulating head portion;

an articulating foot portion separate from the articulating head portion; and an articulating center portion disposed between the articulating head portion and the articulating foot portion;

wherein the articulating head portion, the articulating center portion and the articulating foot portion articulate with respect to each other independent of rotation of the rotating and pivoting frame and of pivoting movement of the articulating bed member with respect to the horizontal support surface and the rotating and pivoting frame is pivotally connected to the articulating center to achieve pivoting movement of the articulating bed member with respect to the horizontal support surface.

17. A rotating and articulating bed comprising:

a fixed bed frame comprising a horizontal support surface comprising a support plate;

an articulating bed member; and a rotating and pivoting frame mounted on the horizontal support surface, in communication with the articulating bed member and rotatable with respect to the horizontal support surface around a vertical axis passing through the horizontal support surface, the rotating and pivoting frame comprising:

a bearing plate comprising a bottom surface having an area; and a plurality of discrete bearings attached to the bearing plate, each one of the plurality of discrete bearings disposed within the area of the bearing plate, spaced along the bearing plate an equal distance from the vertical axis, extending from the bearing plate toward the support plate and comprising a main ball, each main ball in contact with the support plate.

18. The rotating and articulating bed of claim 17, wherein the rotating and pivoting frame further comprises:

a rotating drive shaft extending through the support plate and centered on the vertical axis, the rotating drive shaft comprising:

a mounting flange disposed on a first end of the rotating drive shaft, the mounting flange in contact with the bearing plate; and a second end opposite the first end, the support plate disposed between the first end and the second end; and an upper bearing assembly comprising:

an upper bearing housing disposed between the mounting flange and the support plate; and a thrust ball bearing disposed within the housing, the rotating drive shaft passing through the thrust ball bearing; and a lower bearing assembly comprising:

a lower bearing housing disposed between the support plate and the second end of the rotating drive shaft; and a thrust ball bearing disposed within the lower bearing housing, the rotating drive shaft passing through the thrust ball bearing.

19. The rotating and articulating bed of claim 18, wherein the rotating and pivoting frame further comprises:

a removable drive collar disposed over the rotating drive shaft adjacent the second end such that rotation of the drive collar rotates the rotating drive shaft, the drive collar comprising a pair of arm assemblies extending out from the drive collar; and a rotation actuator in contact with the fixed frame and one of the arm assemblies.

20. The rotating and articulating bed of claim 19, wherein the rotating and pivoting frame further comprises:

a lower bearing assembly threaded locking ring threaded onto the rotating drive shaft between the second end of the rotating drive shaft and the lower bearing assembly; and a drive collar threaded locking ring threaded onto the rotating drive shaft at the second end of the rotating drive shaft, the drive collar threaded locking ring in contact with drive collar.

* * * * *